US007577567B2

(12) United States Patent
Ehara

(10) Patent No.: US 7,577,567 B2
(45) **Date of Patent: *Aug. 18, 2009**

(54) MULTIMODE SPEECH CODING APPARATUS AND DECODING APPARATUS

(75) Inventor: Hiroyuki Ehara, Yokohama (JP)

(73) Assignee: Panasonic Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/637,128

(22) Filed: Dec. 12, 2006

(65) Prior Publication Data

US 2007/0088543 A1 Apr. 19, 2007

Related U.S. Application Data

(63) Continuation of application No. 09/914,916, filed on Sep. 6, 2001, now Pat. No. 7,167,828.

(51) Int. Cl.
*G10L 19/12* (2006.01)

(52) U.S. Cl. ..... 704/223; 704/219; 704/222; 704/228; 704/220; 704/230

(58) Field of Classification Search ..... 704/219, 704/222, 228, 223, 220, 221, 212, 230
See application file for complete search history.

(56) References Cited

U.S. PATENT DOCUMENTS

| | | | | |
|---|---|---|---|---|
| 5,012,519 | A | 4/1991 | Adlersberg et al. | |
| 5,060,269 | A | 10/1991 | Zinser | |
| 5,265,167 | A | 11/1993 | Akamine et al. | |
| 5,490,130 | A | 2/1996 | Akagiri | |
| 5,596,676 | A | 1/1997 | Swaminathan et al. | |
| 5,732,392 | A * | 3/1998 | Mizuno et al. | 704/233 |
| 5,751,903 | A * | 5/1998 | Swaminathan et al. | 704/230 |
| 5,802,109 | A | 9/1998 | Sano | |
| 5,826,221 | A * | 10/1998 | Aoyagi | 704/200 |
| 6,269,331 | B1 * | 7/2001 | Alanara et al. | 704/205 |
| 6,334,105 | B1 * | 12/2001 | Ehara | 704/258 |
| 6,453,288 | B1 | 9/2002 | Yasunaga et al. | |
| 6,691,084 | B2 * | 2/2004 | Manjunath et al. | 704/221 |
| 6,765,931 | B1 * | 7/2004 | Rabenko et al. | 370/493 |
| 6,799,160 | B2 * | 9/2004 | Yasunaga et al. | 704/223 |
| 7,167,828 | B2 * | 1/2007 | Ehara | 704/223 |
| 7,272,556 | B1 * | 9/2007 | Aguilar et al. | 704/230 |

FOREIGN PATENT DOCUMENTS

EP 0813183 12/1997

(Continued)

OTHER PUBLICATIONS

Supplementary European Search Report dated Jul. 28, 2005.

(Continued)

*Primary Examiner*—Vijay B Chawan
(74) *Attorney, Agent, or Firm*—Dickinson Wright, PLLC

(57) ABSTRACT

Square sum calculator 603 calculates a square sum of evolution in smoothed quantized LSP parameter for each order. A first dynamic parameter is thereby obtained. Square sum calculator 605 calculates a square sum using a square value of each order. The square sum is a second dynamic parameter. Maximum value calculator 606 selects a maximum value from among square values for each order. The maximum value is a third dynamic parameter. The first to third dynamic parameters are output to mode determiner 607, which determines a speech mode by judging the parameters with respective thresholds to output mode information.

6 Claims, 18 Drawing Sheets

FOREIGN PATENT DOCUMENTS

| | | |
|---|---|---|
| EP | 1024477 | 8/2000 |
| JP | 06131000 | 5/1994 |
| JP | 08185199 | 7/1996 |
| JP | 09179593 | 7/1997 |
| JP | 09152896 | 10/1997 |
| JP | 11119798 | 4/1999 |
| JP | 2000163096 | 6/2000 |
| JP | 2000235400 | 8/2000 |

OTHER PUBLICATIONS

M. Oshikiri, et al., "A 2.4 kbps Variable Bit Rate ADP-CELP Speech Coder", vol. J81-A No. 11, pp. 1492-5000, 1998, with partial English Translation.

M. Schroeder, et al., "Code-Excited Linear Prediction (CELP): High-quality Speech at Very Low Bit Rates", Proc. ICASSP-85, 25.1.1, pp. 937-940, 1985.

* cited by examiner $0 < \gamma \leqq 1.0$、FOR EXAMPLE $\gamma$ IS 0.994

MULTIMODE SPEECH CODING APPARATUS AND DECODING APPARATUS

This is a continuation application of Ser. No. 09/914,916, filed Sep. 6, 2001, the priority of which is claimed under 35 USC §120.

TECHNICAL FIELD

The present invention relates to a low-bit-rate speech coding apparatus which performs coding on a speech signal to transmit, for example, in a mobile communication system, and more particularly, to a CELP (Code Excited Linear Prediction) type speech coding apparatus which separates the speech signal to vocal tract information and excitation information to represent.

BACKGROUND ART

In the fields of digital mobile communications and speech storage are used speech coding apparatuses which compress speech information to encode with high efficiency for utilization of radio signals and recording media. Among them, the system based on a CELP (Code Excited Linear Prediction) system is carried into practice widely for the apparatuses operating at medium to low bit rates. The technology of the CELP is described in "Code-Excited Linear Prediction (CELP): High-quality Speech at Very Low Bit Rates" by M. R. Schroeder and B. S. At al, Proc. ICASSP-85, 25.1.1., pp. 937-940, 1985.

In the CELP type speech coding system, speech signals are divided into predetermined frame lengths (about 5 ms to 50 ms), linear prediction of the speech signals is performed for each frame, the prediction residual (excitation vector signal) obtained by the linear prediction for each frame is encoded using an adaptive code vector and random code vector comprised of known waveforms. The adaptive code vector is selected to use from an adaptive codebook storing previously generated excitation vectors, while the random code vector is selected to use from a random codebook storing a predetermined number of pre-prepared vectors with predetermined shapes. Examples used as the random code vectors stored in the random codebook are random noise sequence vectors and vectors generated by arranging a few pulses at different positions.

A conventional CELP coding apparatus performs the LPC synthesis and quantization, pitch search, random codebook search, and gain codebook search using input digital signals, and transmits the quantized LPC code (L), pitch period (P), a random codebook index (S) and a gain codebook index (G) to a decoder.

However, the above-mentioned conventional speech coding apparatus needs to cope with voiced speeches, unvoiced speeches and background noises using a single type of random codebook, and therefore it is difficult to encode all the input signals with high quality.

DISCLOSURE OF INVENTION

It is an object of the present invention to provide a multimode speech coding apparatus and speech decoding apparatus capable of providing excitation coding with multimode without newly transmitting mode information, in particular, performing judgment of speech region/non-speech region in addition to judgment of voiced region/unvoiced region, and further increasing the improvement of coding/decoding performance performed with the multimode.

It is a subject matter of the present invention to perform mode determination using static/dynamic characteristics of a quantized parameter representing spectral characteristics, and to further perform switching of excitation structures and post processing based on the mode determination indicating the speech region/non-speech region or voiced region/unvoiced region.

BEST MODE FOR CARRYING OUT THE INVENTION

Embodiments of the present invention will be described below specifically with reference to accompanying drawings.

First Embodiment

Figure 1:
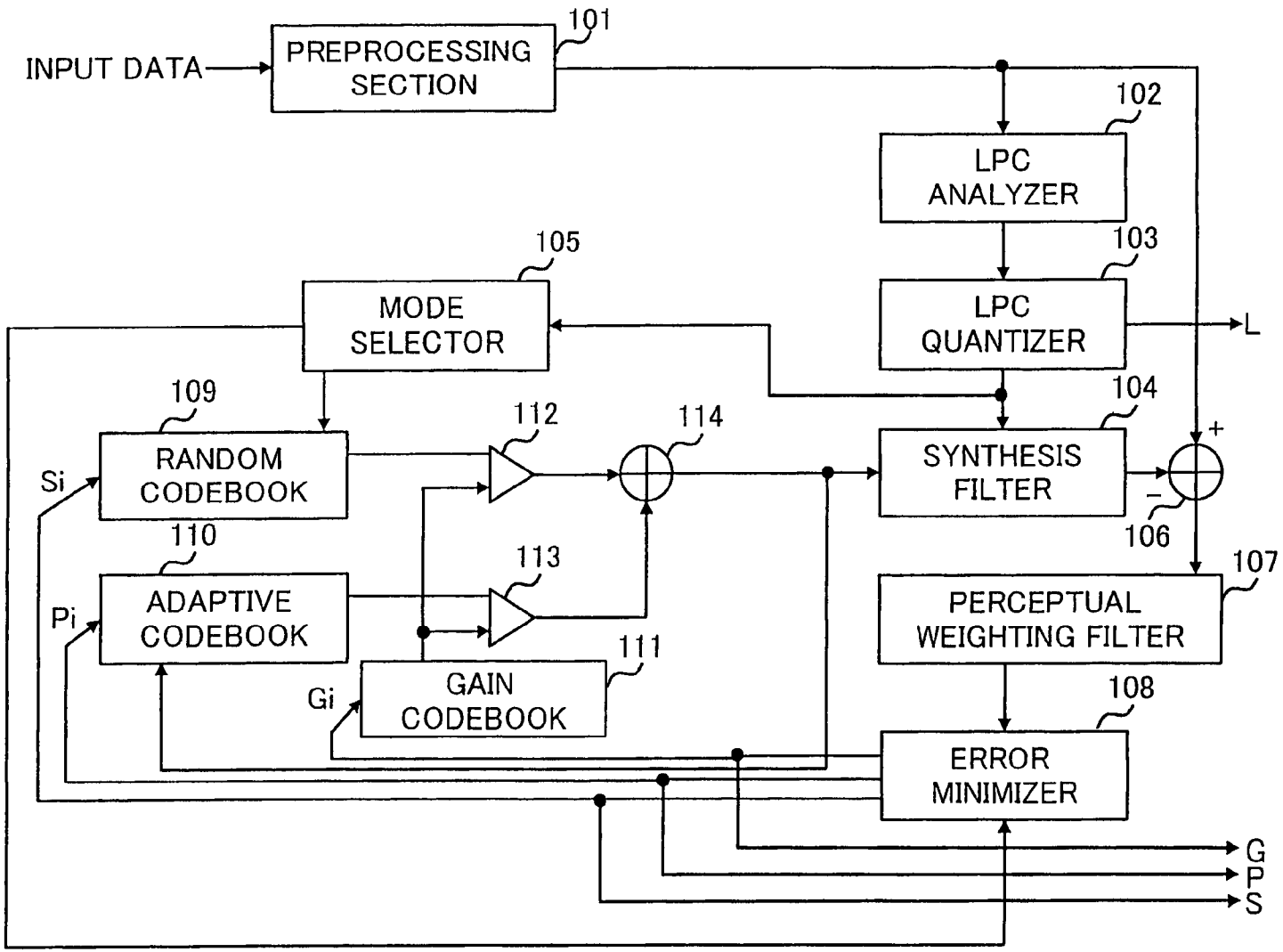
FIG. 1 is a block diagram illustrating a speech coding apparatus in a first embodiment of the present invention.

FIG. 1 is a block diagram illustrating a configuration of a speech coding apparatus according to the first embodiment of the present invention. Input data comprised of, for example, digital speech signals is input to preprocessing section 101. Preprocessing section 101 performs processing such as cutting of a direct current component or bandwidth limitation of the input data using a high-pass filter and band-pass filter to output to LPC analyzer 102 and adder 106. In addition, although it is possible to perform successive coding processing without performing any processing in preprocessing section 101, the coding performance is improved by performing the above-mentioned processing. Further as the preprocessing, other processing is also effective for transforming into a waveform facilitating coding with no deterioration of subjective quality, such as, for example, operation of pitch period and interpolation processing of pitch waveforms.

LPC analyzer 102 performs linear prediction analysis, and calculates linear predictive coefficients (LPC) to output to LPC quantizer 103.

LPC quantizer 103 quantizes the input LPC, outputs the quantized LPC to synthesis filter 104 and mode selector 105, and further outputs a code L that represents the quantized LPC to a decoder. In addition, the quantization of LPC is generally performed after LPC is converted to LSP (Line Spectrum Pair) with good interpolation characteristics. It is general that LSP is represented by LSF (Line Spectrum Frequency).

As synthesis filter 104, an LPC synthesis filter is constructed using the input quantized LPC. With the constructed synthesis filter, filtering processing is performed on an excitation vector signal input from adder 114, and the resultant signal is output to adder 106.

Mode selector 105 determines a mode of random codebook 109 using the quantized LPC input from LPC quantizer 103.

At this time, mode selector 105 stores previously input information of quantized LPC, and performs the selection of mode using both characteristics of an evolution of quantized LPC between frames and of the quantized LPC in a current frame. There are at least two types of the modes, examples of which are a mode corresponding to a voiced speech segment, and a mode corresponding to an unvoiced speech segment and stationary noise segment. Further, as information for use in selecting a mode, it is not necessary to use the quantized LPC themselves, and it is more effective to use converted parameters such as the quantized LSP, reflective coefficients and linear prediction residual power. When LPC quantizer 103 has an LSP quantizer as its structural element (when LPC are converted to LSP to quantize), quantized LSP may be one parameter to be input to mode selector 105.

Adder 106 calculates an error between the preprocessed input data input from preprocessing section 101 and the synthesized signal to output to perceptual weighting filter 107.

Perceptual weighting filter 107 performs perceptual weighting on the error calculated in adder 106 to output to error minimizer 108.

Error minimizer 108 adjusts a random codebook index, adaptive codebook index (pitch period), and gain codebook index respectively to output to random codebook 109, adaptive codebook 110, and gain codebook 111, determines a random code vector, adaptive code vector, and random codebook gain and adaptive codebook gain respectively to be generated in random codebook 109, adaptive codebook 110, and gain code book 111 so as to minimize the perceptual weighted error input from perceptual weighting filter 107, and outputs a code S representing the random code vector, a code P representing the adaptive code vector, and a code G representing gain information to a decoder.

Random codebook 109 stores a predetermined number of random code vectors with different shapes, and outputs the random code vector designated by the index Si of random code vector input from error minimizer 108. Random codebook 109 has at least two types of modes. For example, random codebook 109 is configured to generate a pulse-like random code vector in the mode corresponding to a voiced speech segment, and further generate a noise-like random code vector in the mode corresponding to an unvoiced speech segment and stationary noise segment. The random code vector output from random codebook 109 is generated with a single mode selected in mode selector 105 from among at least two types of the modes described above, and multiplied by the random codebook gain in multiplier 112 to be output to adder 114.

Adaptive codebook 110 performs buffering while updating the previously generated excitation vector signal sequentially, and generates the adaptive code vector using the adaptive codebook index (pitch period (pitch lag)) Pi input from error minimizer 108. The adaptive code vector generated in adaptive codebook 110 is multiplied by the adaptive codebook gain in multiplier 113, and then output to adder 114.

Gain codebook 111 stores a predetermined number of sets of the adaptive codebook gain and random codebook gain (gain vector), and outputs the adaptive codebook gain component and random codebook gain component of the gain vector designated by the gain codebook index Gi input from error minimizer 108 respectively to multipliers 113 and 112. In addition, if the gain codebook is constructed with a plurality of stages, it is possible to reduce a memory amount required for the gain codebook and a computation amount required for gain codebook search. Further, if a number of bits assigned for the gain codebook are sufficient, it is possible to scalar-quantize the adaptive codebook gain and random codebook gain independently of each other. Moreover, it is considered to vector-quantize and matrix-quantize collectively the adaptive codebook gains and random codebook gains of a plurality of subframes.

Adder 114 adds the random code vector and the adaptive code vector respectively input from multipliers 112 and 113 to generate the excitation vector signal, and outputs the generated excitation vector signal to synthesis filter 104 and adaptive codebook 110.

In addition, in this embodiment, although only random codebook 109 is provided with the multimode, it is possible to provide adaptive codebook 110 and gain codebook 111 with such multimode, and thereby to further improve the quality.

Figure 3:
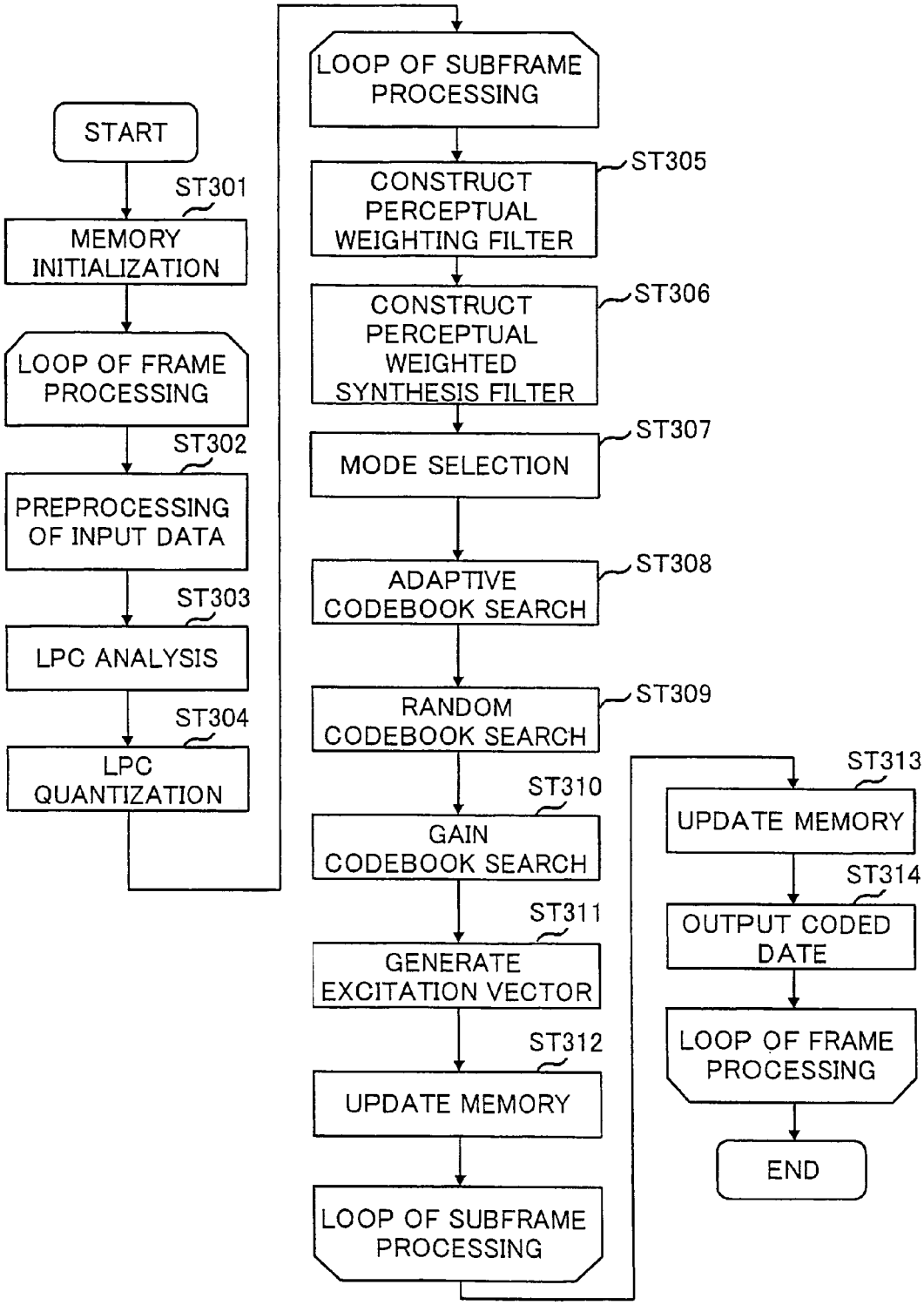
FIG. 3 is a flowchart for speech coding processing in the first embodiment of the present invention.

The flow of processing of a speech coding method in the above-mentioned embodiment is next described with reference to FIG. 3. This explanation describes the case that in the speech coding processing, the processing is performed for each unit processing with a predetermined time length (frame with the time length of a few tens msec), and further the processing is performed for each shorter unit processing (subframe) obtained by dividing a frame into an integer number of portions.

In step (hereinafter abbreviated as ST) 301, all the memories such as the contents of the adaptive codebook, synthesis filter memory and input buffer are cleared.

Next, in ST302, input data such as a digital speech signal corresponding to a frame is input, and filters such as a high-pass filter or band-pass filter are applied to the input data to perform offset cancellation and bandwidth limitation of the input data. The preprocessed input data is buffered in an input buffer to be used for the following coding processing.

Next, in ST303, the LPC (linear predictive coefficients) analysis is performed and LP (linear predictive) coefficients are calculated.

Next, in ST304, the quantization of the LP coefficients calculated in ST303 is performed. While various quantization methods of LPC are proposed, the quantization can be performed effectively by converting LPC into LSP parameters with good interpolation characteristics to apply the predictive quantization utilizing the multistage vector quantization and inter-frame correlation. Further, for example in the case where a frame is divided into two subframes to be processed, it is general to quantize the LPC of the second subframe, and to determine the LPC of the first subframe by the interpolation processing using the quantized LPC of the second subframe of the last frame and the quantized LPC of the second subframe of the current frame.

Next, in ST305, the perceptual weighting filter that performs the perceptual weighting on the preprocessed input data is constructed.

Next, in ST306, a perceptual weighted synthesis filter that generates a synthesized signal of a perceptual weighting domain from the excitation vector signal is constructed. This filter is comprised of the synthesis filter and perceptual weighting filter in a subordination connection. The synthesis filter is constructed with the quantized LPC quantized in ST304, and the perceptual weighting filter is constructed with the LPC calculated in ST303.

Next, in ST307, the selection of mode is performed. The selection of mode is performed using static and dynamic characteristics of the quantized LPC quantized in ST304. Examples specifically used are an evolution of quantized LSP, reflective coefficients and prediction residual power which can be calculated from the quantized LPC. Random codebook search is performed according to the mode selected in this step. There are at least two types of the modes to be selected in this step. An example considered is a two-mode structure of a voiced speech mode, and an unvoiced speech and stationary noise mode.

Next, in ST 308, adaptive codebook search is performed. The adaptive codebook search is to search for an adaptive code vector such that a perceptual weighted synthesized waveform is generated that is the closest to a waveform obtained by performing the perceptual weighting on the preprocessed input data. A position from which the adaptive code vector is fetched is determined so as to minimize an error between a signal obtained by filtering the preprocessed input data with the perceptual weighting filter constructed in ST305, and a signal obtained by filtering the adaptive code vector fetched from the adaptive codebook as an excitation vector signal with the perceptual weighted synthesis filter constructed in ST306.

Next, in ST309, the random codebook search is performed. The random codebook search is to select a random code vector to generate an excitation vector signal such that a perceptual weighted synthesized waveform is generated that is the closest to a waveform obtained by performing the perceptual weighting on the preprocessed input data. The search is performed in consideration of that the excitation vector signal is generated by adding the adaptive code vector and random code vector. Accordingly, the excitation vector signal is generated by adding the adaptive code vector determined in ST308 and the random code vector stored in the random codebook. The random code vector is selected from the random codebook so as to minimize an error between a signal obtained by filtering the generated excitation vector signal with the perceptual weighted synthesis filter constructed in ST306, and the signal obtained by filtering the preprocessed input data with the perceptual weighting filter constructed in ST305.

In addition, in the case where processing such as pitch synchronization (pitch enhancement) is performed on the random code vector, the search is performed also in consideration of such processing. Further this random codebook has at least two types of the modes. For example, the search is performed by using the random codebook storing pulse-like random code vectors in the mode corresponding to the voiced speech segment, while using the random codebook storing noise-like random code vectors in the mode corresponding to the unvoiced speech segment and stationary noise segment. Which mode of the random codebook is used in the search is selected in ST307.

Next, in ST310, gain codebook search is performed. The gain codebook search is to select from the gain codebook a pair of the adaptive codebook gain and random codebook gain respectively to be multiplied by the adaptive code vector determined in ST308 and the random code vector determined in ST309. The excitation vector signal is generated by adding the adaptive code vector multiplied by the adaptive codebook gain and the random code vector multiplied by the random codebook gain. The pair of the adaptive codebook gain and random codebook gain is selected from the gain codebook so as to minimize an error between a signal obtained by filtering the generated excitation vector signal with the perceptual weighted synthesis filter constructed in ST306, and the signal obtained by filtering the preprocessed input data with the perceptual weighting filter constructed in ST305.

Next, in ST311, the excitation vector signal is generated. The excitation vector signal is generated by adding a vector obtained by multiplying the adaptive code vector selected in ST308 by the adaptive codebook gain selected in ST310 and a vector obtained by multiplying the random code vector selected in ST309 by the random codebook gain selected in ST310.

Next, in ST312, the update of the memory used in a loop of the subframe processing is performed. Examples specifically performed are the update of the adaptive codebook, and the update of states of the perceptual weighting filter and perceptual weighted synthesis filter.

In addition, when the adaptive codebook gain and fixed codebook gain are quantized separately, it is general that the adaptive codebook gain is quantized immediately after ST 308, and that the random codebook gain is performed immediately after ST309.

In ST305 to ST312, the processing is performed on a subframe-by-subframe basis.

Next, in ST313, the update of a memory used in a loop of the frame processing is performed. Examples specifically performed are the update of states of the filter used in the preprocessing section, the update of quantized LPC buffer, and the update of input data buffer.

Next, in ST314, coded data is output. The coded data is output to a transmission path while being subjected to bit stream processing and multiplexing processing corresponding to the form of the transmission.

In ST302 to 304 and ST313 to 314, the processing is performed on a frame-by-frame basis. Further the processing on a frame-by-frame basis and subframe-by-subframe is iterated until the input data is consumed.

Second Embodiment

Figure 2:
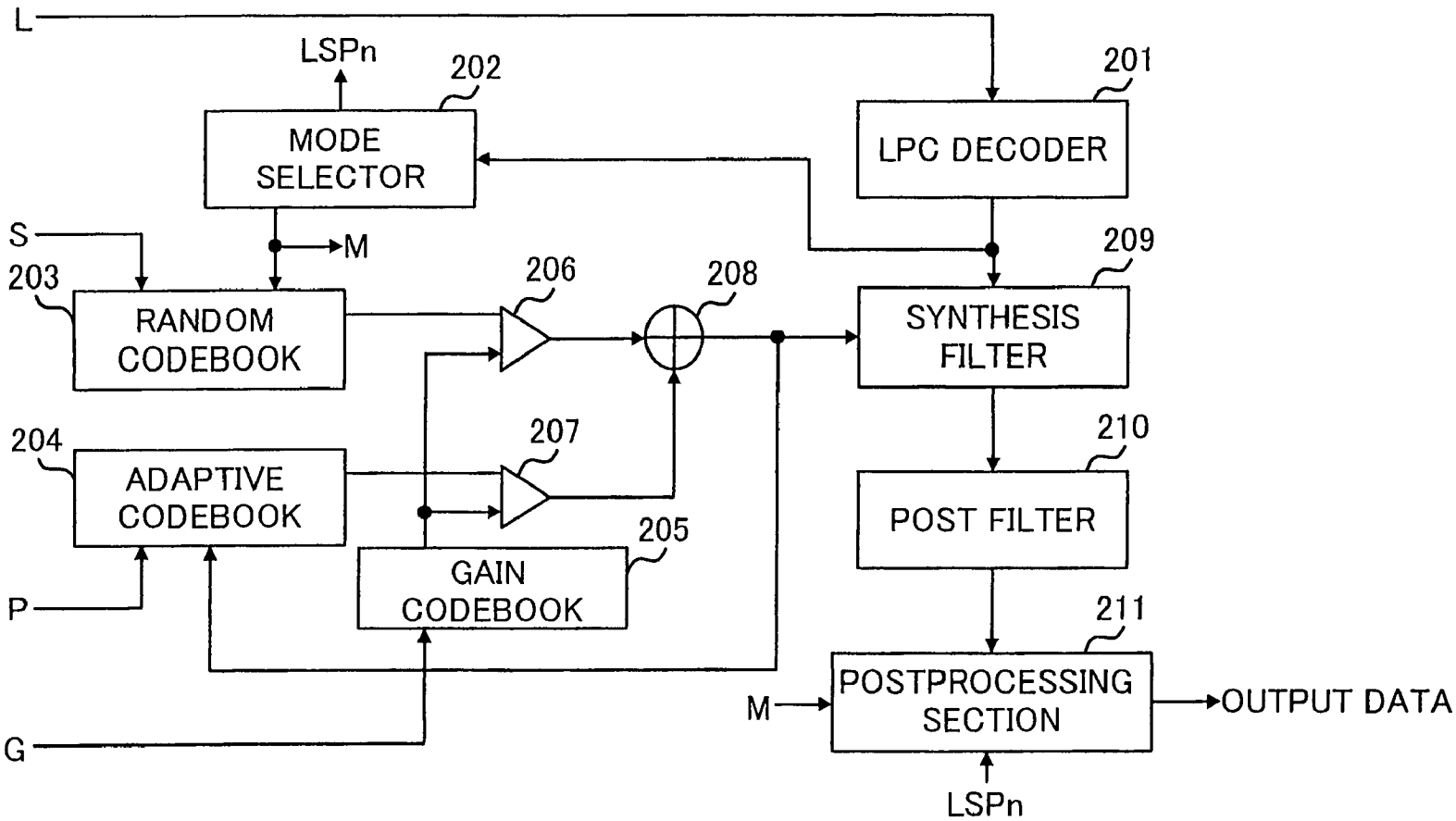
FIG. 2 is a block diagram illustrating a speech decoding apparatus in a second embodiment of the present invention.

FIG. 2 shows a configuration of a speech decoding apparatus according to the second embodiment of the present invention.

The code L representing quantized LPC, code S representing a random code vector, code P representing an adaptive code vector, and code G representing gain information, each transmitted from a coder, are respectively input to LPC decoder 201, random codebook 203, adaptive codebook 204 and gain codebook 205.

LPC decoder 201 decodes the quantized LPC from the code L to output to mode selector 202 and synthesis filter 209.

Mode selector 202 determines a mode for random codebook 203 and postprocessing section 211 using the quantized LPC input from LPC decoder 201, and outputs mode information M to random codebook 203 and postprocessing section 211. Further, mode selector 202 obtains average LSP (LSPn) of a stationary noise region using the quantized LSP parameter output from LPC decoder 201, and outputs LSPn to postprocessing section 211. In addition, mode selector 202 also stores previously input information of quantized LPC, and performs the selection of mode using both characteristics of an evolution of quantized LPC between frames and of the quantized LPC in a current frame. There are at least two types of the modes, examples of which are a mode corresponding to voiced speech segments, a mode corresponding to unvoiced speech segments, and mode corresponding to a stationary noise segments. Further, as information for use in selecting a mode, it is not necessary to use the quantized LPC themselves, and it is more effective to use converted parameters such as the quantized LSP, reflective coefficients and linear prediction residual power. When LPC decoder 201 has an LSP decoder as its structural element (when LPC are converted to LSP to quantize), decoded LSP may be one parameter to be input to mode selector 105.

Random codebook 203 stores a predetermined number of random code vectors with different shapes, and outputs a random code vector designated by the random codebook index obtained by decoding the input code S. This random codebook 203 has at least two types of the modes. For example, random codebook 203 is configured to generate a pulse-like random code vector in the mode corresponding to a voiced speech segment, and to further generate a noise-like random code vector in the modes corresponding to an unvoiced speech segment and stationary noise segment. The random code vector output from random codebook 203 is generated with a single mode selected in mode selector 202 from among at least two types of the modes described above, and multiplied by the random codebook gain Gs in multiplier 206 to be output to adder 208.

Adaptive codebook 204 performs buffering while updating the previously generated excitation vector signal sequentially, and generates an adaptive code vector using the adaptive codebook index (pitch period (pitch lag)) obtained by decoding the input code P. The adaptive code vector generated in adaptive codebook 204 is multiplied by the adaptive codebook gain Ga in multiplier 207, and then output to adder 208.

Gain codebook 205 stores a predetermined number of sets of the adaptive codebook gain and random codebook gain (gain vector), and outputs the adaptive codebook gain component and random codebook gain component of the gain vector designated by the gain codebook index obtained by decoding the input code G respectively to multipliers 207, 206.

Adder 208 adds the random code vector and the adaptive code vector respectively input from multipliers 206 and 207 to generate the excitation vector signal, and outputs the generated excitation vector signal to synthesis filter 209 and adaptive codebook 204.

As synthesis filter 209, an LPC synthesis filter is constructed using the input quantized LPC. With the constructed synthesis filter, the filtering processing is performed on the excitation vector signal input from adder 208, and the resultant signal is output to post filter 210.

Post filter 210 performs the processing to improve subjective qualities of speech signals such as pitch emphasis, formant emphasis, spectral tilt compensation and gain adjustment on the synthesized signal input from synthesis filter 209 to output to postprocessing section 211.

Postprocessing section 211 adaptively generates a pseudo stationary noise to multiplex on the signal input from post filter 210, and thereby improves subjective qualities. The processing is adaptively performed using the mode information M input from mode selector 202 and average LSP (LSPn) of a noise region. The specific postprocessing will be described later. In addition, although in this embodiment the mode information M output from mode selector 202 is used in both the mode selection for random codebook 203 and mode selection for postprocessing section 211, using the mode information M for either of the mode selections is also effective.

Figure 4:
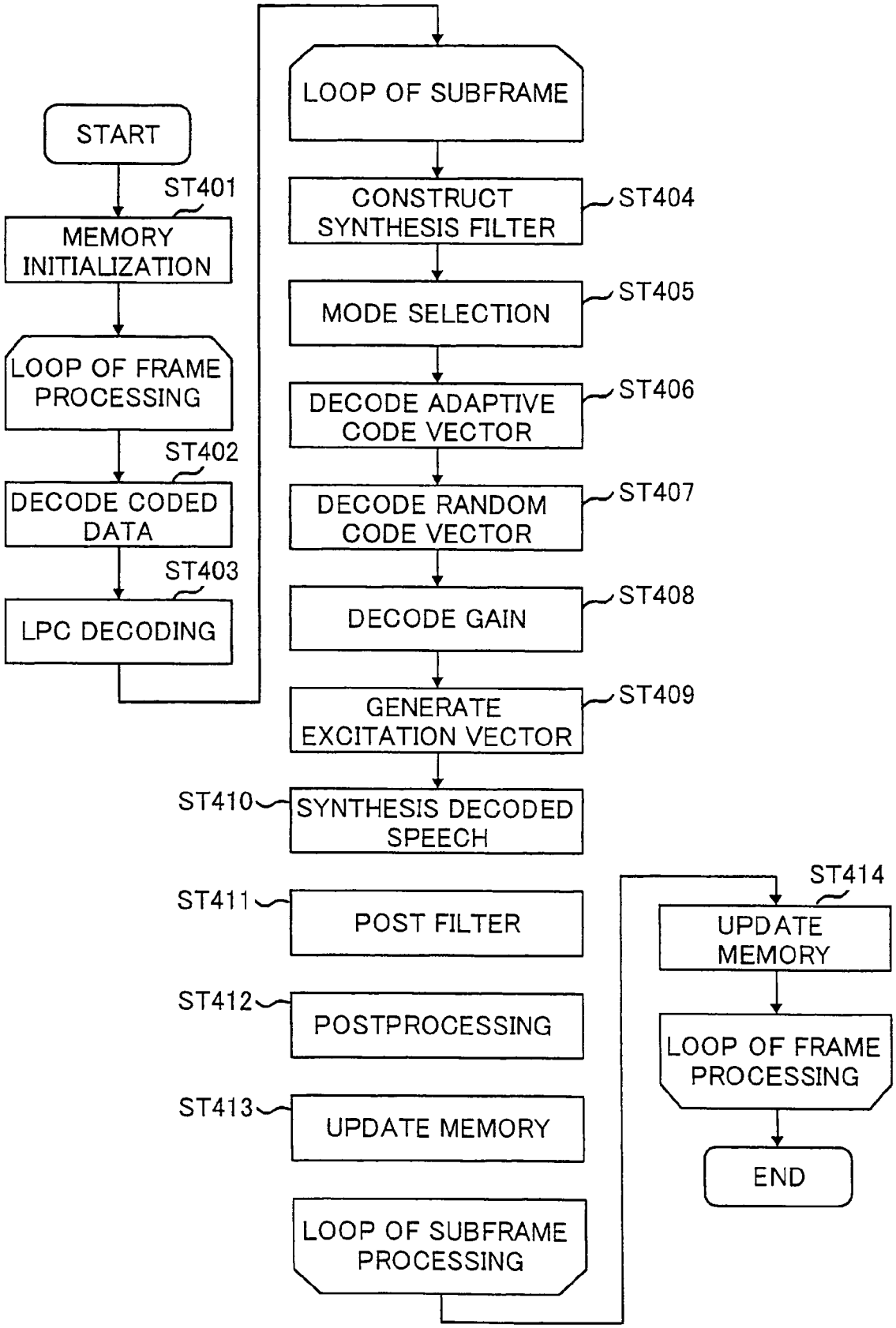
FIG. 4 is a flowchart for speech decoding processing in the second embodiment of the present invention.

The flow of the processing of the speech decoding method in the above-mentioned embodiment is next described with reference to FIG. 4. This explanation describes the case that in the speech coding processing, the processing is performed for each unit processing with a predetermined time length (frame with the time length of a few tens msec), and further the processing is performed for each shorter unit processing (subframe) obtained by dividing a frame into an integer number of portions.

In ST401, all the memories such as the contents of the adaptive codebook, synthesis filter memory and output buffer are cleared.

Next, in ST402, coded data is decoded. Specifically, multiplexed received signals are demultiplexed, and the received signals constructed in bitstreams are converted into codes respectively representing quantized LPC, adaptive code vector, random code vector and gain information.

Next, in ST403, the LPC are decoded. The LPC are decoded from the code representing the quantized LPC obtained in ST402 with the reverse procedure of the quantization of the LPC described in the first embodiment.

Next, in ST404, the synthesis filter is constructed with the LPC decoded in ST403.

Next, in ST405, the mode selection for the random codebook and postprocessing is performed using the static and dynamic characteristics of the LPC decoded in ST403. Examples specifically used are an evolution of quantized LSP, reflective coefficients calculated from the quantized LPC, and prediction residual power. The decoding of the random code vector and postprocessing is performed according to the mode selected in this step. There are at least two types of the modes, which are, for example, comprised of a mode corresponding to voiced speech segments, mode corresponding to unvoiced speech segments and mode corresponding to stationary noise segments.

Next, in ST406, the adaptive code vector is decoded. The adaptive code vector is decoded by decoding a position from which the adaptive code vector is fetched from the adaptive codebook using the code representing the adaptive code vector, and fetching the adaptive code vector from the obtained position.

Next, in ST407, the random code vector is decoded. The random code vector is decoded by decoding the random codebook index from the code representing the random code vector, and retrieving the random code vector corresponding to the obtained index from the random codebook. When other processing such as pitch synchronization of the random code vector is applied, a decoded random code vector is obtained after further being subjected to the pitch synchronization. This random codebook has at least two types of the modes. For example, this random codebook is configured to generate a pulse-like random code vector in the mode corresponding to voiced speech segments, and further generate a noise-like random code vector in the modes corresponding to unvoiced speech segments and stationary noise segments.

Next, in ST408, the adaptive codebook gain and random codebook gain are decoded. The gain information is decoded by decoding the gain codebook index from the code representing the gain information, and retrieving a pair of the adaptive codebook gain and random codebook gain instructed by the obtained index from the gain codebook.

Next, in ST409, the excitation vector signal is generated. The excitation vector signal is generated by adding a vector obtained by multiplying the adaptive code vector selected in ST406 by the adaptive codebook gain selected in ST408 and a vector obtained by multiplying the random code vector selected in ST407 by the random codebook gain selected in ST408.

Next, in ST410, a decoded signal is synthesized. The excitation vector signal generated in ST409 is filtered with the synthesis filter constructed in ST404, and thereby the decoded signal is synthesized.

Next, in ST411, the postfiltering processing is performed on the decoded signal. The postfiltering processing is comprised of the processing to improve subjective qualities of decoded signals, in particular, decoded speech signals, such as pitch emphasis processing, formant emphasis processing, spectral tilt compensation processing and gain adjustment processing.

Next, in ST412, the final postprocessing is performed on the decoded signal subjected to postfiltering processing. The postprocessing is performed corresponding to the mode selected in ST405, and will be described specifically later. The signal generated in this step becomes output data.

Next, in ST413, the update of the memory used in a loop of the subframe processing is performed. Specifically performed are the update of the adaptive codebook, and the update of states of filters used in the postfiltering processing.

In ST404 to ST413, the processing is performed on a subframe-by-subframe basis.

Next, in ST414, the update of a memory used in a loop of the frame processing is performed. Specifically performed are the update of quantized (decoded) LPC buffer, and update of output data buffer.

In ST402 to 403 and ST414, the processing is performed on a frame-by-frame basis. The processing on a frame-by-frame basis is iterated until the coded data is consumed.

Third Embodiment

Figure 5A:
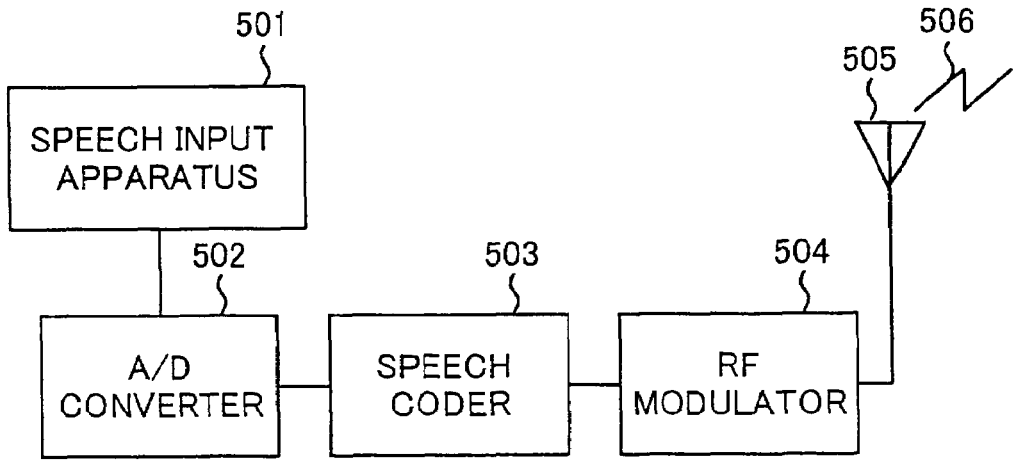
FIG. 5A is a block diagram illustrating a configuration of a speech signal transmission apparatus in a third embodiment of the present invention.
Figure 5B:
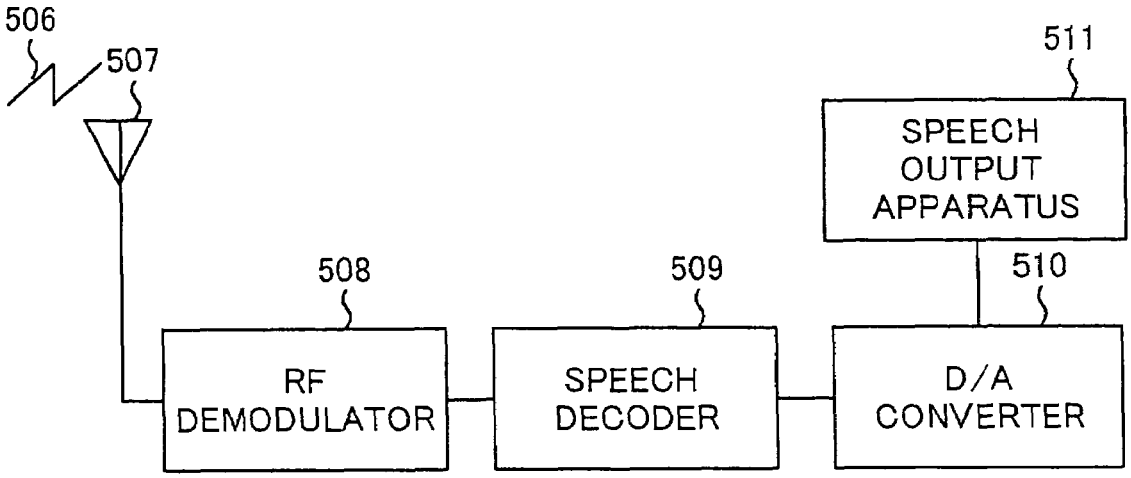
FIG. 5B is a block diagram illustrating a configuration of a speech signal reception apparatus in the third embodiment of the present invention.

FIG. 5 is a block diagram illustrating a speech signal transmission apparatus and reception apparatus respectively provided with the speech coding apparatus of the first embodiment and speech decoding apparatus of the second embodiment. FIG. 5A illustrates the transmission apparatus, and FIG. 5B illustrates the reception apparatus.

In the speech signal transmission apparatus in FIG. 5A, speech input apparatus 501 converts a speech into an electric analog signal to output to A/D converter 502. A/D converter 502 converts the analog speech signal into a digital speech signal to output to speech coder 503. Speech coder 503 performs speech coding processing on the input signal, and outputs coded information to RF modulator 504. RF modulator 504 performs modulation, amplification and code spreading on the coded speech signal information to transmit as a radio signal, and outputs the resultant signal to transmission antenna 505. Finally, the radio signal (RF signal) 506 is transmitted from transmission antenna 505.

Meanwhile, the reception apparatus in FIG. 5B receives the radio signal (RF signal) 506 with reception antenna 507, and outputs the received signal to RF demodulator 508. RF demodulator 508 performs the processing such as code despreading and demodulation to convert the radio signal into coded information, and outputs the coded information to speech decoder 509. Speech decoder 509 performs decoding processing on the coded information and outputs a digital decoded speech signal to D/A converter 510. D/A converter 510 converts the digital decoded speech signal output from speech decoder 509 into an analog decoded speech signal to output to speech output apparatus 511. Finally, speech output apparatus 511 converts the electric analog decoded speech signal into a decoded speech to output.

It is possible to use the above-mentioned transmission apparatus and reception apparatus as a mobile station apparatus and base station apparatus in mobile communication apparatuses such as portable telephones. In addition, the medium that transmits the information is not limited to the radio signal described in this embodiment, and it may be possible to use optosignals, and further possible to use cable transmission paths.

Further, it may be possible to achieve the speech coding apparatus described in the first embodiment, the speech decoding apparatus described in the second embodiment, and the transmission apparatus and reception apparatus described in the third embodiment by recording the corresponding program in a recording medium such as a magnetic disk, optomagnetic disk, and ROM cartridge to use as software. The use of thus obtained recording medium enables a personal computer using such a recording medium to achieve the speech coding/decoding apparatus and transmission/reception apparatus.

Fourth Embodiment

The fourth embodiment descries examples of configurations of mode selectors 105 and 202 respectively in the above-mentioned first and second embodiments.

Figure 6:
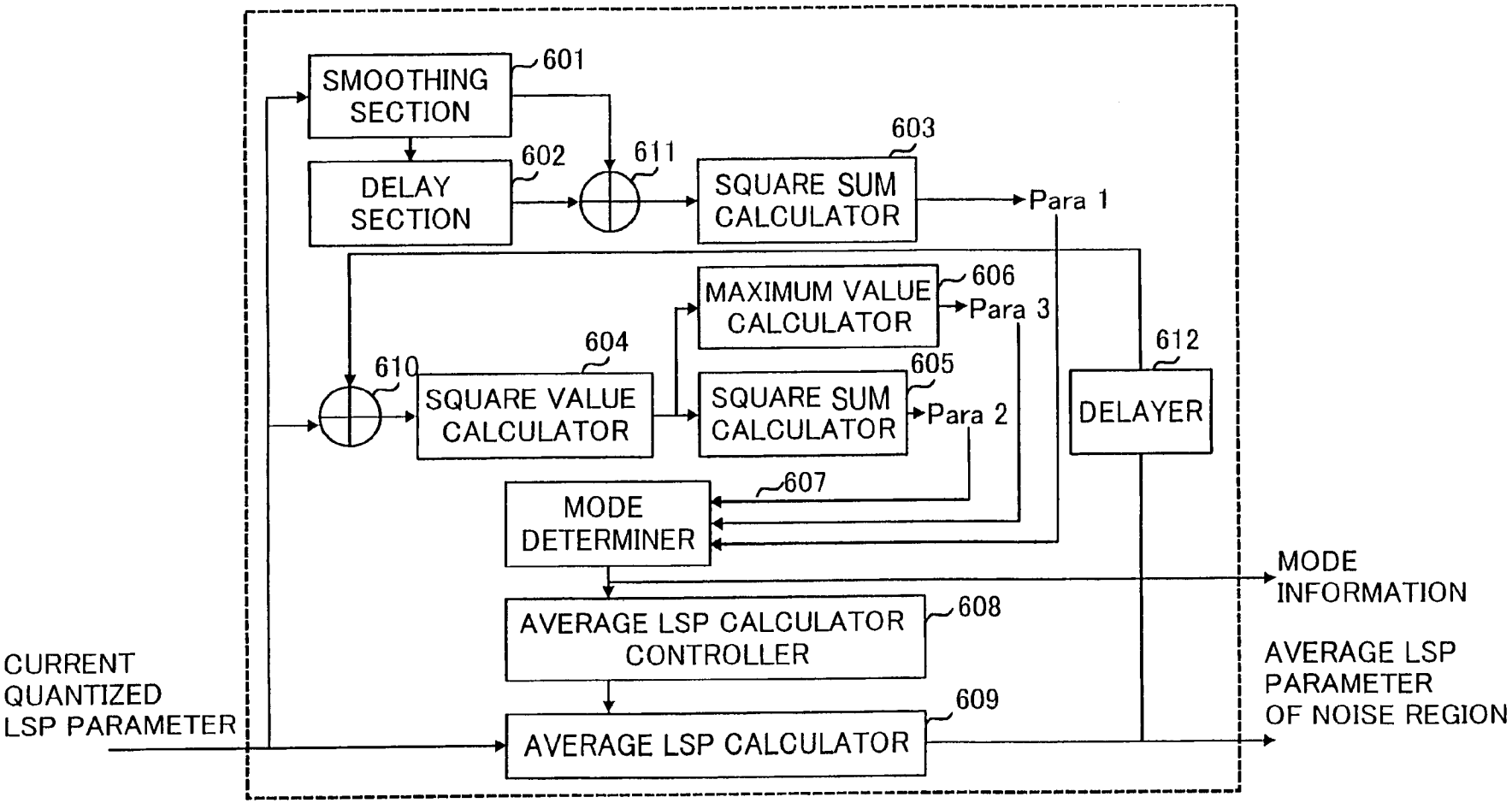
FIG. 6 is a block diagram illustrating a configuration of a mode selector in a fourth embodiment of the present invention.

FIG. 6 illustrates a configuration of a mode selector according to the fourth embodiment.

In the mode selector according this embodiment, smoothing section 601 receives as its input a current quantized LSP parameter to perform smoothing processing. Smoothing section 601 performs the smoothing processing expressed by following equation (1) on each order quantized LSP parameter, which is input for each unit processing time, as time-series data:

$$Ls[i]=(1-\alpha)\times Ls[i]+\alpha\times L[i],\ i=1,2,\ldots,M,\ 0<\alpha<1 \quad (1)$$

Ls[i]: ith order smoothed quantized LSP parameter

L[i]: ith order quantized LSP parameter $\alpha$: smoothing coefficient

M: LSP analysis order

In addition, in equation (1), a value of $\alpha$ is set at about 0.7 to avoid too strong smoothing. The smoothed quantized LSP parameter obtained with above equation (1) is input to adder 611 through delay section 602, while being directly input to adder 611. Delay section 602 delays the input smoothed quantized LSP parameter by a unit processing time to output to adder 611.

Adder 611 receives the smoothed quantized LSP parameter at the current unit processing time, and the smoothed quantized LSP parameter at the last unit processing time. Adder 611 calculates an evolution between the smoothed quantized LSP parameter at the current unit processing time, and the smoothed quantized LSP parameter at the last unit processing time. The evolution is calculated for each order of LSP parameter. The result calculated by adder 611 is output to square sum calculator 603.

Square sum calculator 603 calculates the square sum of evolution for each order between the smoothed quantized LSP parameter at the current unit processing time, and the smoothed quantized LSP parameter at the last unit processing time. A first dynamic parameter (Para 1) is thereby obtained. By comparing the first dynamic parameter with a threshold, it is possible to identify whether a region is a speech region. Namely, when the first dynamic parameter is larger than a threshold Th1, the region is judged to be a speech region. The judgment is performed in mode determiner 607 described later.

Average LSP calculator 609 calculates the average LSP parameter at a noise region based on equation (1) in the same way as in smoothing section 601, and the resultant is output to adder 610 through delayer 612. In addition, a in equation (1) is controlled by average LSP calculator controller 608. A value of a is set to the extent of 0.05 to 0, thereby performing extremely strong smoothing processing, and the average LSP parameter is calculated. Specifically, it is considered to set the value of $\alpha$ to 0 at a speech region and to calculate the average (to perform the smoothing) only at regions except the speech region.

Adder 610 calculates for each order an evolution between the quantized LSP parameter at the current unit processing time, and the averaged quantized LSP parameter at the noise region calculated at the last unit processing time by average LSP calculator 609 to output to square value calculator 604. In other words, after the mode is determined in the manner described below, average LSP calculator 609 calculates the average LSP of the noise region to output to delayer 612, and the average LSP of the noise region, with which delayer 612 provides a one unit processing time delay, is used in next unit processing in adder 610.

Square value calculator 604 receives as its input evolution information of quantized LSP parameter output from adder 610, calculates a square value of each order, and outputs the value to square sum calculator 605, while outputting the value to maximum value calculator 606.

Square sum calculator 605 calculates a square sum using the square value of each order. The calculated square sum is a second dynamic parameter (Para 2). By comparing the second dynamic parameter with a threshold, it is possible to identify whether a region is a speech region. Namely, when the second dynamic parameter is larger than a threshold Th2, the region is judged to be a speech region. The judgment is performed in mode determiner 607 described later.

Maximum value calculator 606 selects a maximum value from among square values for each order. The maximum value is a third dynamic parameter (Para 3). By comparing the third dynamic parameter with a threshold, it is possible to identify whether a region is a speech region. Namely, when the third dynamic parameter is larger than a threshold Th3, the region is judged to be a speech region. The judgment is performed in mode determiner 607 described later. The judgment with the third parameter and threshold is performed to detect a change that is buried by averaging the square errors of all the orders so as to judge whether a region is a speech region with more accuracy.

For example, when most of a plurality of results of square sum does not exceed the threshold with one or two results exceeding the threshold, judging the average result with the threshold results in a case that the averaged result does not exceed the threshold, and that the speech region is not detected. By using the third dynamic parameter to judge with the threshold in this way, even when most of the results do not exceed the threshold with one or two results exceeding the threshold, judging the maximum value with the threshold enables the speech region to be detected with more accuracy.

The first to third dynamic parameters described above are output to mode determiner 607 to compare with respective thresholds, and thereby a speech mode is determined and is output as mode information. The mode information is also output to average LSP calculator controller 608. Average LSP calculator controller 608 controls average LSP calculator 609 according to the mode information.

Specifically, when the average LSP calculator 609 is controlled, the value of $\alpha$ in equation (1) is switched in a range of 0 to about 0.05 to switch the smoothing strength. In the simplest example, $\alpha$ is set to 0 ($\alpha$=0) is in the speech mode to turn off the smoothing processing, while $\alpha$ is set to about 0.05 ($\alpha$=about 0.05) in the non-speech (stationary noise) mode so as to calculate the average LSP of the stationary noise region with the strong smoothing processing. In addition, it is also considered to control the value of $\alpha$ for each order of LSP, and in this case it is further considered to update part of (for example, order contained in a particular frequency band) LSP also in the speech mode.

Figure 7:
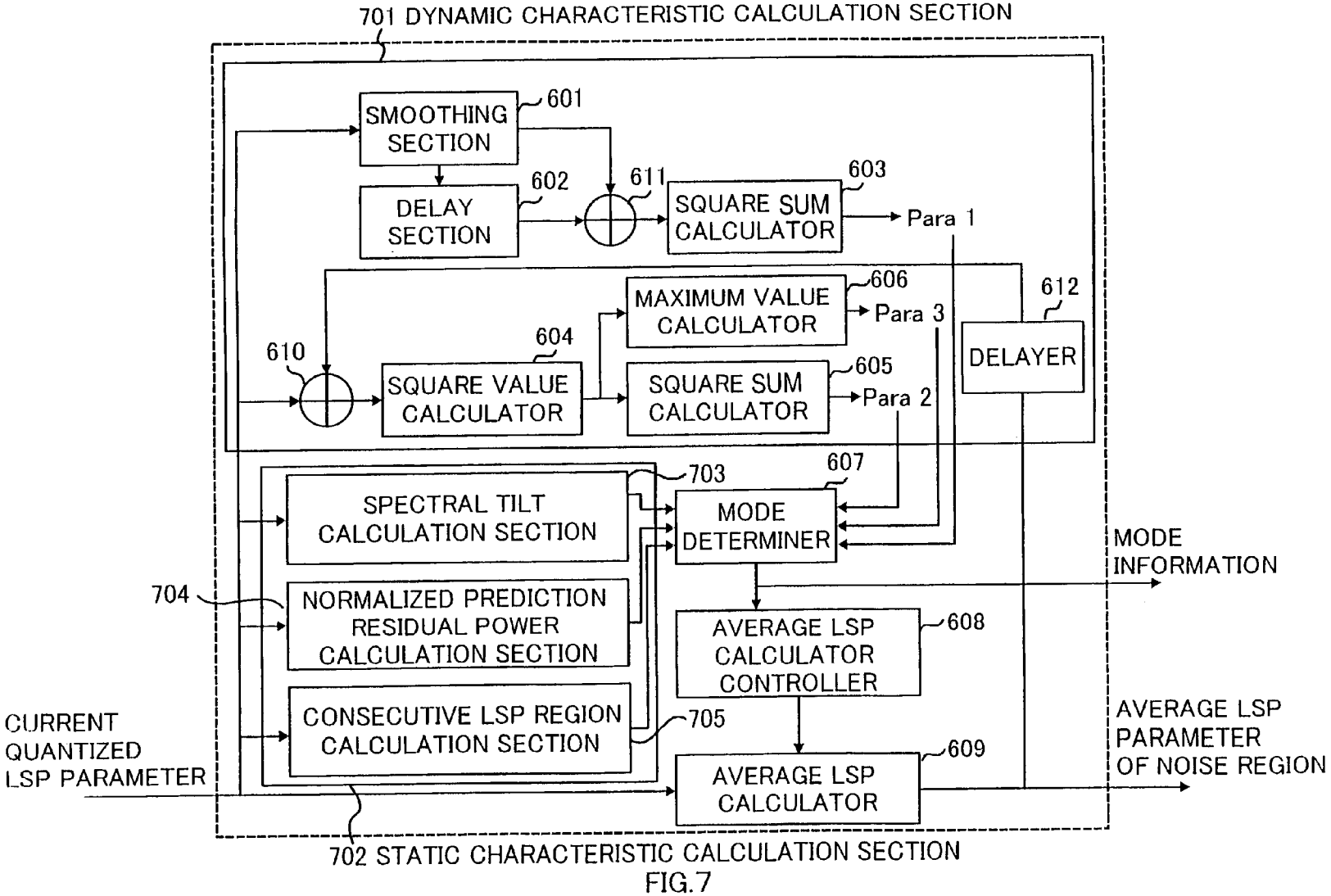
FIG. 7 is a block diagram illustrating a configuration of a mode selector in the fourth embodiment of the present invention.

FIG. 7 is a block diagram illustrating a configuration of a mode determiner with the above configuration.

The mode determiner is provided with dynamic characteristic calculation section 701 that extracts a dynamic characteristic of quantized LSP parameter, and static characteristic calculation section 702 that extracts a static characteristic of quantized LSP parameter. Dynamic characteristic calculation section 701 is comprised of sections from smoothing section 601 to delayer 612 in FIG. 6.

Static characteristic calculation section 702 calculates prediction residual power from the quantized LSP parameter in normalized prediction residual power calculation section 704. The prediction residual power is provided to mode determiner 607.

Further consecutive LSP region calculation section 705 calculates a region between consecutive orders of the quantized LSP parameters as expressed in following equation (2):

$$Ld[i]=L[i+1]-L[i],\ i=1, 2, \ldots, M-1 \quad (2)$$

L[i]: ith order quantized LSP parameter

The value calculated in consecutive LSP region calculation section 705 is provided to mode determiner 607.

Spectral tilt calculation section 703 calculates spectral tilt information using the quantized LSP parameter. Specifically, as a parameter representative of the spectral tilt, a first-order reflective coefficient is usable. The reflective coefficients and liner predictive coefficients (LPC) are convertible into each other using an algorithm of Levinson-Durbin, whereby it is possible to obtain the first-order reflective coefficient from the quantized LPC, and the first-order reflective coefficient is used as the spectral tilt information. In addition, normalized prediction residual power calculation section 704 calculates the normalized prediction residual power from the quantized LPC using the algorithm of Levinson-Durbin. In other words, the reflective coefficient and normalized prediction residual power are obtained concurrently from the quantized LPC using the same algorithm. The spectral tilt information is provided to mode determiner 607.

Static characteristic calculation section 702 is composed of sections from spectral tilt calculation section 703 to consecutive LSP region calculation section 705 described above.

Outputs of dynamic characteristic calculation section 701 and of static characteristic calculation section 702 are provided to mode determiner 607. Mode determiner 603 further receives, as its input, an amount of the evolution in the smoothed quantized LSP parameter from square value calculator 603, a distance between the average quantized LSP of the noise region and current quantized LSP parameter from square sum calculator 605, a maximum value of the distance between the average quantized LSP parameter of the noise region and current quantized LSP parameter from maximum value calculator 606, the quantized prediction residual power from normalized prediction residual power calculation section 704, the spectral tilt information of consecutive LSP region data from consecutive LSP region calculation section 705, and variance information from spectral tilt calculation section 703. Using these information, mode determiner 607 judges whether or not an input signal (or decoded signal) at a current unit processing time is of a speech region to determine a mode. The specific method for judging whether or not a signal is of a speech region will be described below with reference to FIG. 8.

Figure 8:
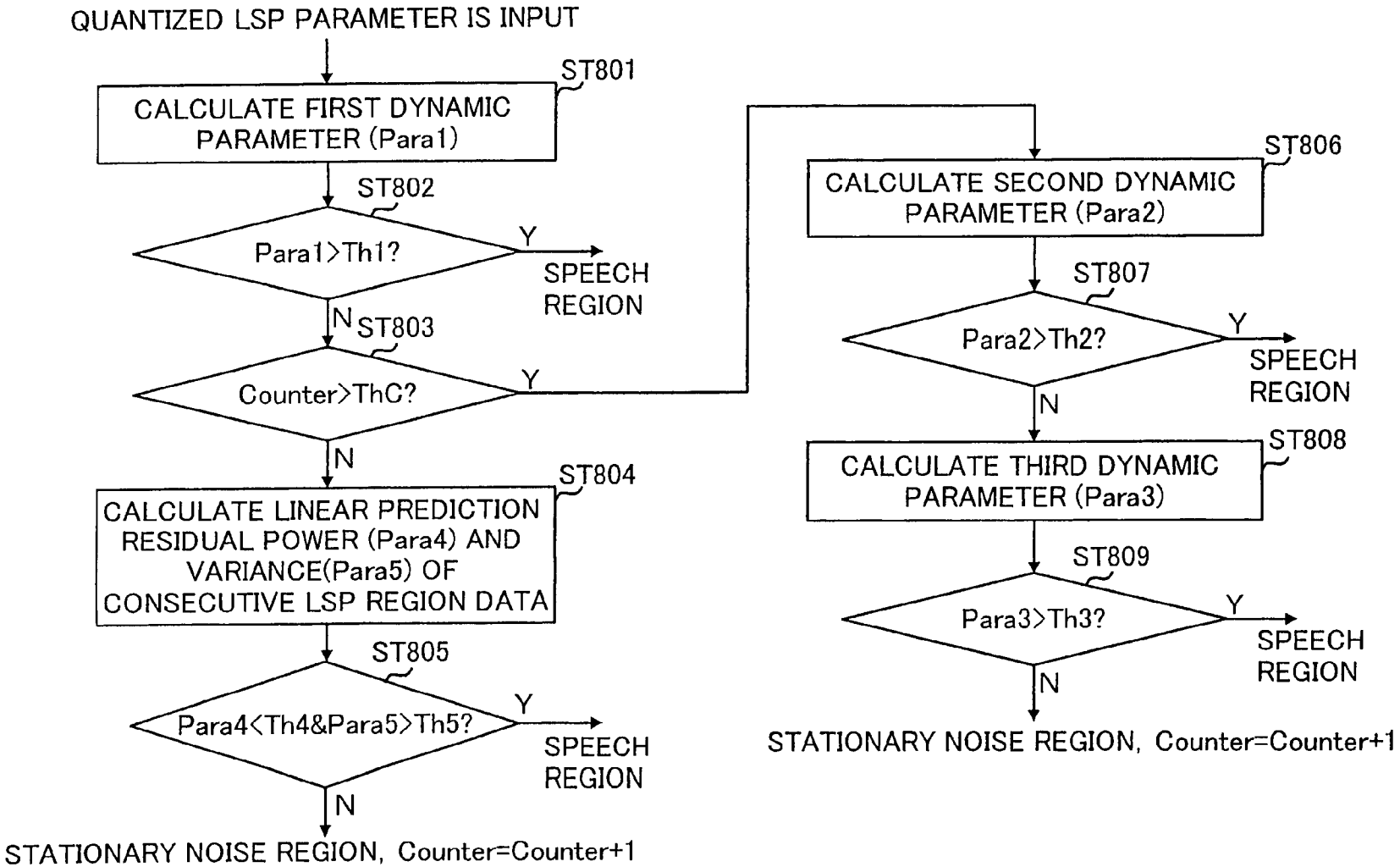
FIG. 8 is a flowchart for the former part of mode selection processing in the fourth embodiment of the present invention.

The speech region judgment method in the above-mentioned embodiment is next explained specifically with reference to FIG. 8.

First, in ST801, the first dynamic parameter (Para 1) is calculated. The specific content of the first dynamic parameter is an amount of the evolution in the quantized LSP parameter for each unit processing time, and expressed with following equation (3):

$$D(t) = \sum_{i=1}^{M} (LSi(t) - LSi(t-1))^2 \tag{3}$$

LSi(t): smoothed quantized LSP at time t

Next, in ST802, it is checked whether or not the first dynamic parameter is larger than a predetermined threshold Th1. When the parameter exceeds the threshold Th1, since the amount of the evolution in the quantized LSP parameter is large, it is judged that the input signal is of a speech region. On the other hand, when the parameter is less than or equal to the threshold Th1, since the amount of the evolution in the quantized LSP parameter is small, the processing proceeds to ST803, and further proceeds to steps for judgment processing with other parameter.

In ST802, when the first dynamic parameter is less than or equal to the threshold Th1, the processing proceeds to ST803, where the number in a counter is checked which is indicative of the number of times the stationary noise region is judged previously. The initial value of the counter is 0, and is incremented by 1 for each unit processing time at which the signal is judged to be of the stationary noise region with the mode determination method. In ST803, when the number in the counter is equal to or less than a predetermined ThC, the processing proceeds to ST804, where it is judged whether or not the input signal is of a speech region using the static parameter. On the other hand, when the number in the counter exceeds the threshold ThC, the processing proceeds to ST806, where it is judged whether or not the input signal is of a speech region using the second dynamic parameter.

In ST804, two types of parameters are calculated. One is the linear prediction residual power (Para4) calculated from the quantized LSP parameter, and the other is the variance of the differential information of consecutive orders of quantized LSP parameters (Para5).

The linear prediction residual power is obtained by converting the quantized LSP parameters into the linear predictive coefficients and using the relation equation in the algorithm of Levinson-Durbin. It is known that the linear prediction residual power tends to be higher at an unvoiced segment than at a voiced segment, and therefore the linear prediction residual power is used as a criterion of the voiced/unvoiced judgment. The differential information of consecutive orders of quantized LSP parameters is expressed with equation (2), and the variance of such data is obtained. However, since a spectral peak tends to exist at a low frequency band depending on the types of noises and bandwidth limitation, it is preferable to obtain the variance using the data from i=2 to M−1 (M is analysis order) in equation (2) without using the differential information of consecutive orders at the low frequency edge (i=1 in equation (2)) to classify input signals into a noise region and a speech region. In the speech signal, since there are about three formants at a telephone band (200 Hz to 3.4 kHz), the LSP regions have wide portions and narrow portions, and therefore the variance of the region data tends to be increased.

On the other hand, in the stationary noise, since there is no formant structure, the LSP regions usually have relatively equal portions, and therefore such a variance tends to be decreased. By the use of these characteristics, it is possible to judge whether or not the input signal is of a speech region. However, as described above, the case arises that a spectral peak exists at a low frequency band depending on the types of noises and frequency characteristics of propagation path. In this case, the LSP region at the lowest frequency band becomes narrow, and therefore the variance obtained by using all the consecutive LSP differential data decreases the difference caused by the presence or absence of the formant structure, thereby lowering the judgment accuracy.

Accordingly, obtaining the variance with the consecutive LSP difference information at the low frequency edge eliminated prevents such deterioration of the accuracy from occurring. However, since such a static parameter has a lower judgment ability than the dynamic parameter, it is preferable to use the static parameter as supplementary information. Two types of parameters calculated in ST804 are used in ST805.

Next, in ST805, two types of parameters calculated in ST804 are processed with respective thresholds. Specifically, in the case where the linear prediction residual power (Para4) is less than the threshold Th4 and the variance (Para5) of consecutive LSP region data is more than the threshold Th5, it is judged that the input signal is of a speech region. In other cases, it is judged that the input signal is of a stationary noise region (non-speech region). When the current segment is judged the stationary noise region, the value of the counter is incremented by 1.

In ST806, the second dynamic parameter (Para2) is calculated. The second dynamic parameter is a parameter indicative of a similarity degree between the average quantized LSP parameter in a previous stationary noise region and the quantized LSP parameter at the current unit processing time, and specifically, as expressed in equation (4), is obtained as the square sum of differential values obtained for each order using the above-mentioned two types of quantized LSP parameters:

$$E(t) = \sum_{i=1}^{M} (Li(t) - LAi)^2 \tag{4}$$

Li(t): quantized LSP at time t (subframe)

LAi: average quantized LSP of a noise region

The obtained second dynamic parameter is processed with the threshold in ST807.

Next in ST807, it is judged whether or not the second dynamic parameter exceeds the threshold Th2. When the second dynamic parameter exceeds the threshold Th2, since the similarity degree to the average quantized LSP parameter in the previous stationary noise region is low, it is judged that the input signal is of the speech region. When the second dynamic parameter is less than or equal to the threshold Th2, since the similarity degree to the average quantized LSP parameter in the previous stationary noise region is high, it is judged that the input signal is of the stationary noise region. The value of the counter is incremented by 1 when the input signal is judged to be of the stationary noise region.

In ST808, the third dynamic parameter (Para3) is calculated. The third dynamic parameter aims at detecting a significant difference between the current quantized LSP and the average quantized LSP of a noise region for a particular order, since such significance can be buried by averaging the square values as shown in the equation (4), and is specifically, as indicated in equation (5), obtained as the maximum value of the quantized LSP parameter of each order. The obtained third dynamic parameter is used in ST808 for the judgement with the threshold.

$$E(t)=\max\{(Li(t)-LAi)\}^2 i=1,2\ldots,M \tag{5}$$

Li(t): quantized LSP at time (subframe) t

LAi: average quantized LSP of a noise region

M: analysis order of LSP (LPC)

Next in ST808, it is judged whether the third dynamic parameter exceeds the threshold Th3. When the third parameter exceeds the threshold Th3, since the similarity degree to the average quantized LSP parameter in the previous stationary noise region is low, it is judged that the input signal is of the speech region. When the third dynamic parameter is less than or equal to the threshold Th3, since the similarity degree to the average quantized LSP parameter in the previous stationary noise region is high, it is judged that the input signal is of the stationary noise region. The value of the counter is incremented by 1 when the input signal is judged to be of the stationary noise region.

The inventor of the present invention found out that when the judgment using only the first and second dynamic parameters causes a mode determination error, the mode determination error arises due to the fact that a value of the average quantized LSP of a noise region is highly similar to that of the quantized LSP of a corresponding region, and that an evolution in the quantized LSP in the corresponding region is very small. However, it was further found out that focusing on the quantized LSP of a particular order finds a significant difference between the average quantized LSP of a noise region and the quantized LSP of the corresponding region. Therefore, as described above, by using the third dynamic parameter, a difference (difference between the average quantized LSP of a noise region and the quantized LSP of the corresponding subframe) of quantized LSP of each order is obtained as well as the square sum of the differences of quantized LSP of all orders, and a region with a large difference even in only one order is judged to be a speech region.

It is thereby possible to perform the mode determination with more accuracy even when a value of the average quantized LSP of a noise region is highly similar to that of the quantized LSP of a corresponding region, and that an evolution in the quantized LSP of the corresponding region is very small.

While this embodiment describes a case that the mode determination is performed using all the first to third dynamic parameters, it may be possible in the present invention to perform the mode determination using the first and third dynamic parameters.

In addition, a coder side may be provided with another algorithm for judging a noise region and may perform the smoothing on the LSP, which is a target of an LSP quantizer, in a region judged to be a noise region. The use of a combination of the above configurations and a configuration for decreasing an evolution in quantized LSP enables the accuracy in the mode determination to be further improved.

Fifth Embodiment

In this embodiment is described a case that an adaptive codebook search range is set corresponding to a mode.

Figure 9:
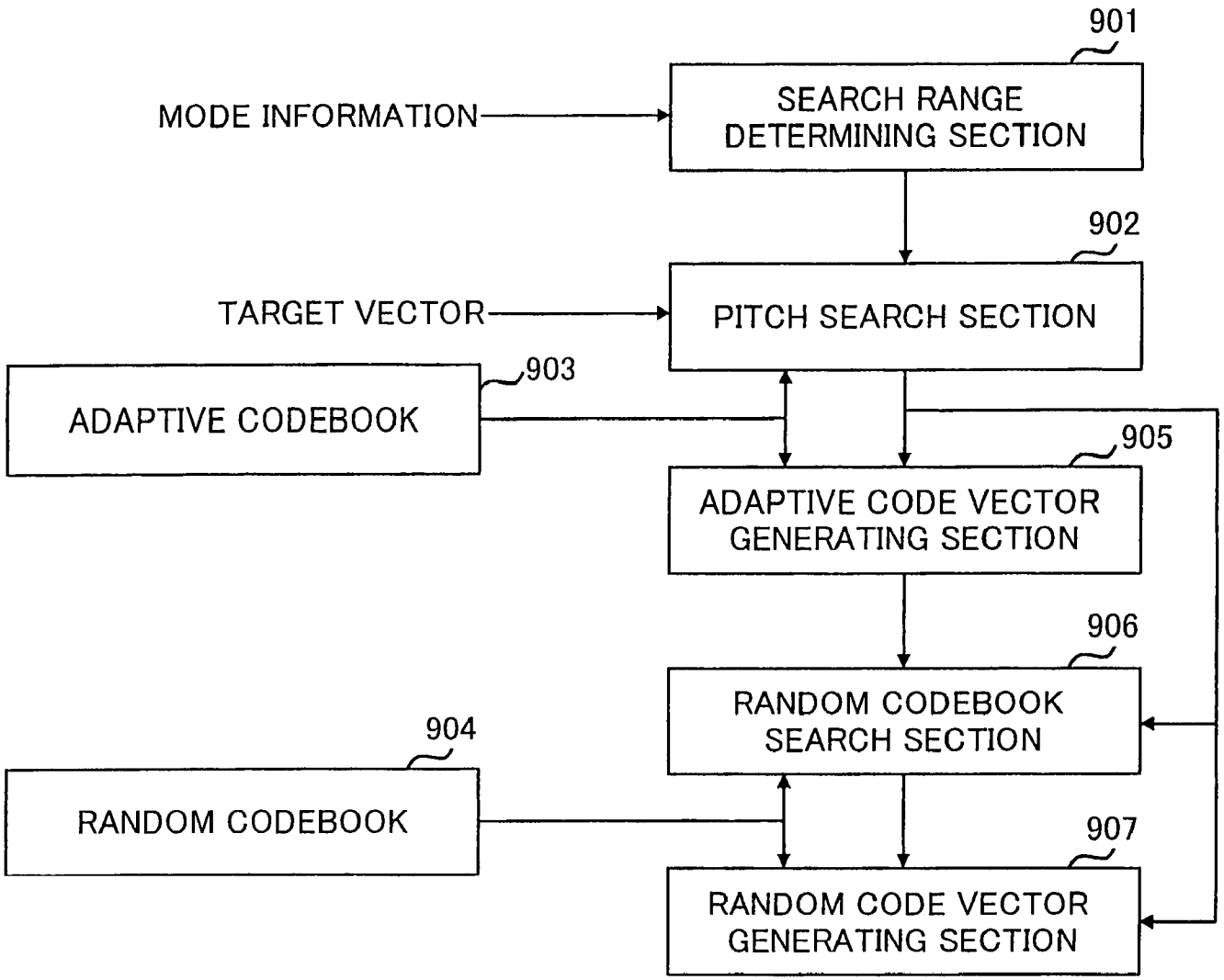
FIG. 9 is a block diagram illustrating a configuration for pitch search in a fifth embodiment of the present invention.

FIG. 9 is a block diagram illustrating a configuration for performing a pitch search according to this embodiment. This configuration includes search range determining section 901 that determines a search range corresponding to the mode information, pitch search section 902 that performs pitch search using a target vector in a determined pitch range, adaptive code vector generating section 905 that generates an adaptive code vector from adaptive codebook 903 using the searched pitch, random codebook search section 906 that searches for a random codebook using the adaptive code vector, target vector and pitch information, and random vector generating section 907 that generates a random code vector from random codebook 904 using the searched random codebook vector and pitch information.

A case will be described below that the pitch search is performed using this configuration. After the mode determination is performed as described in the fourth embodiment, the mode information is input to search range determining section 901. Search range determining section 901 determines a range of the pitch search based on the mode information.

Specifically, in a stationary noise mode (or stationary noise mode and unvoiced mode), the pitch search range is set to a region except a last subframe (in other words, to a previous region before the last subframe), and in other modes, the pitch search range is set to a region including a last subframe. A pitch periodicity is thereby prevented from occurring in a subframe in the stationary noise region. The inventor of the present invention found out that limiting a pitch search range based on the mode information is preferable in a configuration of random codebook due to the following reasons.

It was confirmed that when a random codebook is composed which always applies constant pitch synchronization (pitch enhancement filter for introducing pitch periodicity), even increasing a random codebook (noise-like codebook) rate to 100% still results in that a coding distortion called a swirling distortion or water falling distortion strongly remains. With respect to the swirling distortion, for example, as indicated in "Improvements of Background Sound Coding in Linear Predictive Speech Coders" IEEE Proc. ICASSP'95, pp 25-28 by T. Wigren et al., it is known that the distortion is caused by an evolution in short-term spectrum (frequency characteristic of a synthesis filter). However, a model of the pitch synchronization is apparently not suitable to represent a noise signal with no periodicity, and a possibility is considered that the pitch synchronization causes a particular distortion. Therefore, an effect of the pitch synchronization was examined in the configuration of the random codebook. Two cases were listened that the pitch synchronization on a random code vector was eliminated, and that adaptive code vectors were made all 0. The results indicated that a distortion such as the swirling distortion remains in either case. Further, when the adaptive code vectors were made all 0 and the pitch synchronization on a random code vector was eliminated, it was noticed that the distortion is reduced greatly. It was thereby confirmed that the pitch synchronization in a subframe considerably causes the above-mentioned distortion.

Hence, the inventor of the present invention attempted to limit a search range of pitch period only to a region before the last subframe in generating an adaptive code vector in a noise mode. It is thereby possible to avoid periodical emphasis in a subframe.

In addition, when such control is performed that uses only part of an adaptive codebook corresponding to the mode information, i.e., when control is performed that limits a search range of pitch period in a stationary noise mode, it is possible for a decoder side to detect that a pitch period is short in the stationary noise mode to detect an error.

Figure 10:
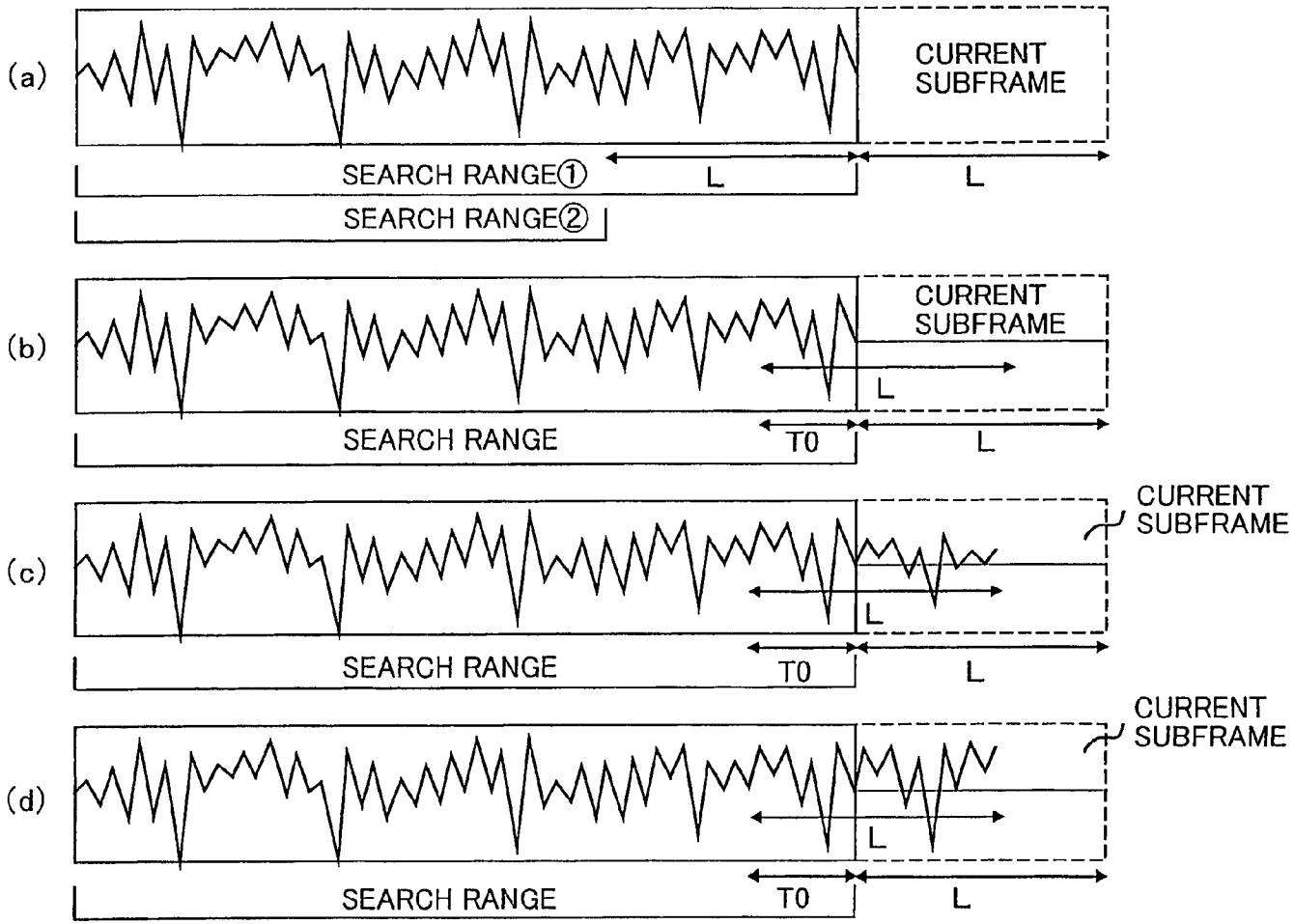
FIG. 10 is a diagram showing a search range of the pitch search in the fifth embodiment of the present invention.

With reference to FIG. 10(*a*), when the mode information is indicative of a stationary noise mode, the search range becomes search range ② limited to a region without a subframe length (L) of the last subframe, while when the mode information is indicative of a mode other than the stationary noise mode, the search range becomes search range ① including the subframe length of the last subframe (in addition, the figure shows that a lower limit of the search range (shortest pitch lag) is set to 0, however, a range of 0 to about 20 samples at 8 kHz-sampling is too short as a pitch period and is not searched generally, and search range ① is set at a range including 15 to 20 or more samples). The switching of the search range is performed in search range determining section 901.

Pitch search section 902 performs the pitch search in the search range determined in search range determining section 901, using the input target vector. Specifically, in the determined search range, the section 902 convolutes an adaptive code vector fetched from adaptive codebook 903 with an impulse response, thereby calculates an adaptive codebook composition, and extracts a pitch that generates an adaptive code vector that minimizes an error between the calculated value and the target vector. Adaptive code vector generating section 905 generates an adaptive code vector with the obtained pitch.

Random codebook search section 906 searches for the random codebook using the obtained pitch, generated adaptive code vector and target vector. Specifically, random codebook search section 906 convolutes a random code vector fetched from random codebook 904 with an impulse response, thereby calculates a random codebook composition, and selects a random code vector that minimizes an error between the calculated value and the target vector.

Thus, in this embodiment, by limiting a search range to a region before a last subframe in a stationary noise mode (or stationary noise mode and unvoiced mode), it is possible to suppress the pitch periodicity on the random code vector, and to prevent the occurrence of a particular distortion caused by the pitch synchronization in composing a random codebook. As a result, it is possible to improve the naturalness of a synthesized stationary noise signal.

In light of suppressing the pitch periodicity, the pitch synchronization gain is controlled in a stationary noise mode (or stationary noise mode and unvoiced mode), in other words, the pitch synchronization gain is decreased to 0 or less than 1 in generating an adaptive code vector in a stationary noise mode, whereby it is possible to suppress the pitch synchronization on the adaptive code vector (pitch periodicity of an adaptive code vector). For example, in a stationery noise mode, the pitch synchronization gain is set to 0 as shown in FIG. 10(*b*), or the pitch synchronization gain is decreased to less than 1 as shown in FIG. 10(*c*). In addition, FIG. 10(*d*) shows a general method for generating an adaptive code vector. "T0" in the figures is indicative of a pitch period.

Figure 11:
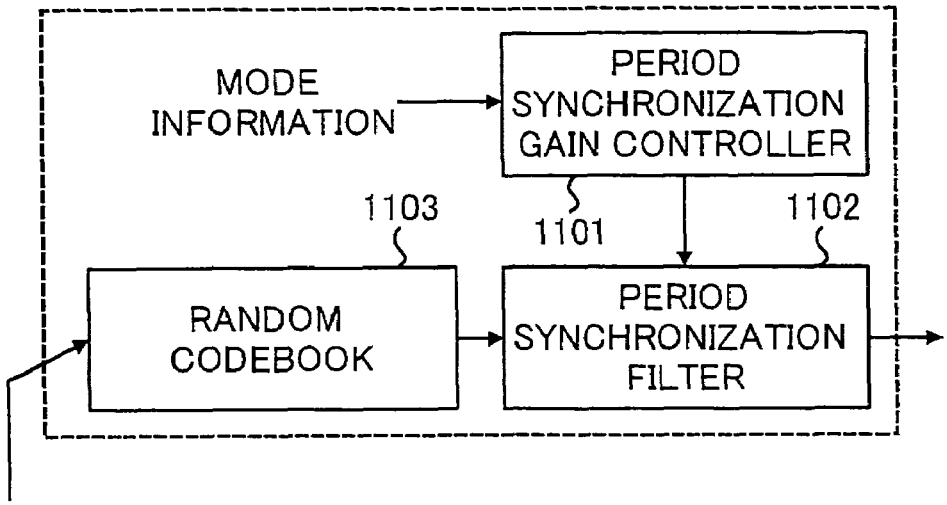
FIG. 11 is a diagram illustrating a configuration for switching a pitch enhancement filter coefficient in the fifth embodiment of the present invention.

The similar control is performed in generating a random code vector. Such control is achieved by a configuration illustrated in FIG. 11. In this configuration, random codebook 1103 inputs a random code vector to pitch enhancement filter 1102, and pitch synchronization gain (pitch enhancement coefficient) controller 1101 controls the pitch synchronization gain (pitch enhancement coefficient) in pitch synchronous (pitch enhancement) filter 1102 corresponding to the mode information.

Further, it is effective to weaken the pitch periodicity on part of the random codebook, while intensifying the pitch periodicity on the other part of the random codebook.

Figure 12:
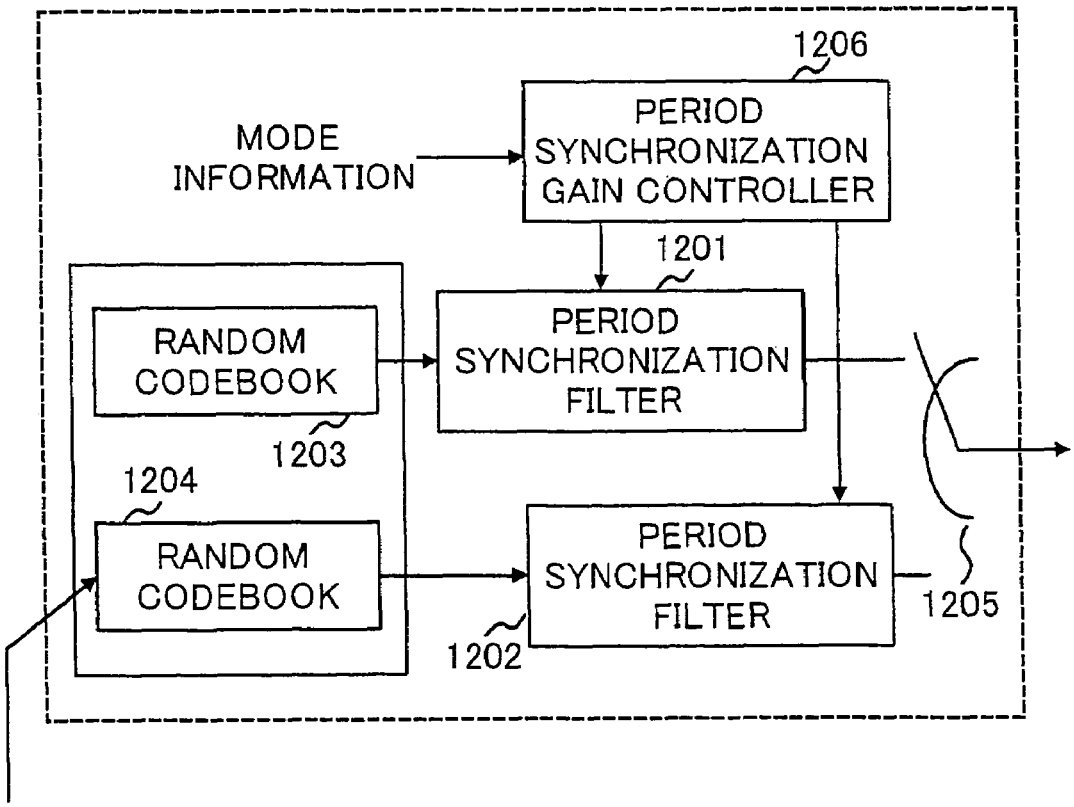
FIG. 12 is a diagram illustrating another configuration for switching a pitch enhancement filter coefficient in the fifth embodiment of the present invention.

Such control is achieved by a configuration as illustrated in FIG. 12. In this configuration, random codebook 1203 inputs a random code vector to pitch synchronous (pitch enhancement) filter 1201, random codebook 1204 inputs a random code vector to pitch synchronous (pitch enhancement) filter 1202, and pitch synchronization gain (pitch enhancement filter coefficient) controller 1206 controls the respective pitch synchronization gain (pitch enhancement filter coefficient) in pitch synchronous (pitch enhancement) filters 1201 and 1202 corresponding to the mode information. For example, when random codebook 1203 is an algebraic codebook and random codebook 1204 is a general random codebook (for example, Gaussian random codebook), the pitch synchronization gain (pitch enhancement filter coefficient) of pitch synchronous (pitch enhancement) filter 1201 for the algebraic codebook is set to 1 or approximately 1, and the pitch synchronization gain (pitch enhancement filter coefficient) of pitch synchronous (pitch enhancement) filter 1202 for the general random codebook is set to a value lower the gain of the filter 1201. An output of either random codebook is selected by switch 1205 to be an output of the entire random codebook.

As described above, in a stationary noise mode (or stationary noise mode and unvoiced mode), by limiting a search range to a region except a last subframe, it is possible to suppress the pitch periodicity on a random code vector, and to suppress an occurrence of a distortion caused by the pitch synchronization in composing a random code vector. As a result, it is possible to improve coding performance on an input signal such as a noise signal with no periodicity.

When the pitch synchronization gain is switched, it may be possible to use the same synchronization gain on the adaptive codebook at a second period and thereafter, or to set the synchronization gain on the adaptive codebook to 0 at a second period and thereafter. In this case, by making signals used as buffer of a current subframe all 0, or by copying the linear prediction residual signal of a current subframe with its signal amplitude attenuated corresponding to the period processing gain, it may be possible to perform the pitch search using the conventional pitch search method.

Sixth Embodiment

In this embodiment is described a case that pitch weighting is switched with mode.

In the pitch period search, a method is generally used that prevents an occurrence of multiplied pith period error (error of selecting a pitch period that is a pitch period multiplied by an integer). However, there is a case that this method causes quality deterioration on a signal with no periodicity. In this embodiment, this method for preventing an occurrence of multiplied pitch period error is turned on or off corresponding to a mode, whereby such deterioration is avoided.

Figure 13:
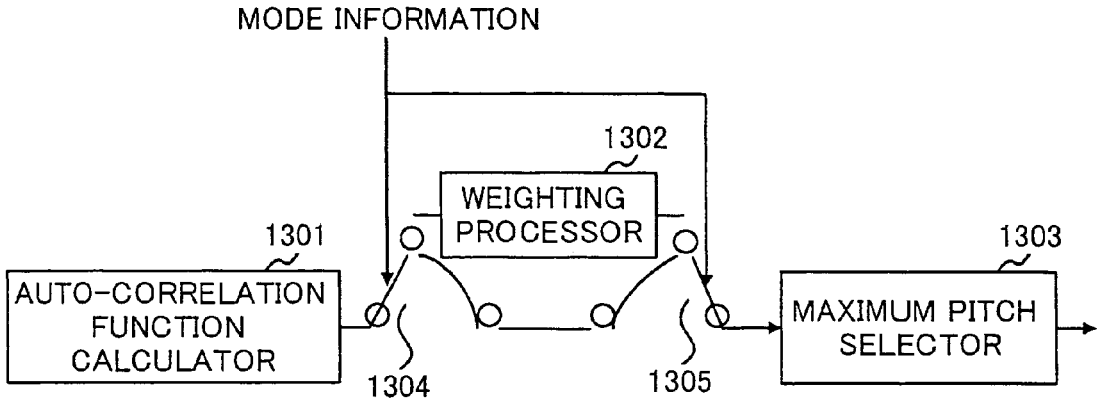
FIG. 13 is a block diagram illustrating a configuration for performing weighting processing in a sixth embodiment of the present invention.

FIG. 13 illustrates a diagram illustrating a configuration of a weighting processing section according to this embodiment. In this embodiment, when a pitch period candidate is selected, an output of auto-correlation function calculator 1301 is switched corresponding to the mode information selected in the above-mentioned embodiment to be input to directly or through weighting processor 1302 to optimum pitch selector 1303. In other words, when the mode information is not indicative of a stationary noise mode, in order to select a shorter pitch, the output of auto-correlation function calculator 1301 is input to weighting processor 1302, and weighting processor 1302 performs weighting processing described later and inputs the resultant to optimum pitch selector 1303. In FIG. 13, reference numerals "1304", and "1305" are switches for switching a section to which the output of auto-correlation function calculator 1301 is input corresponding to the mode information.

Figure 14:
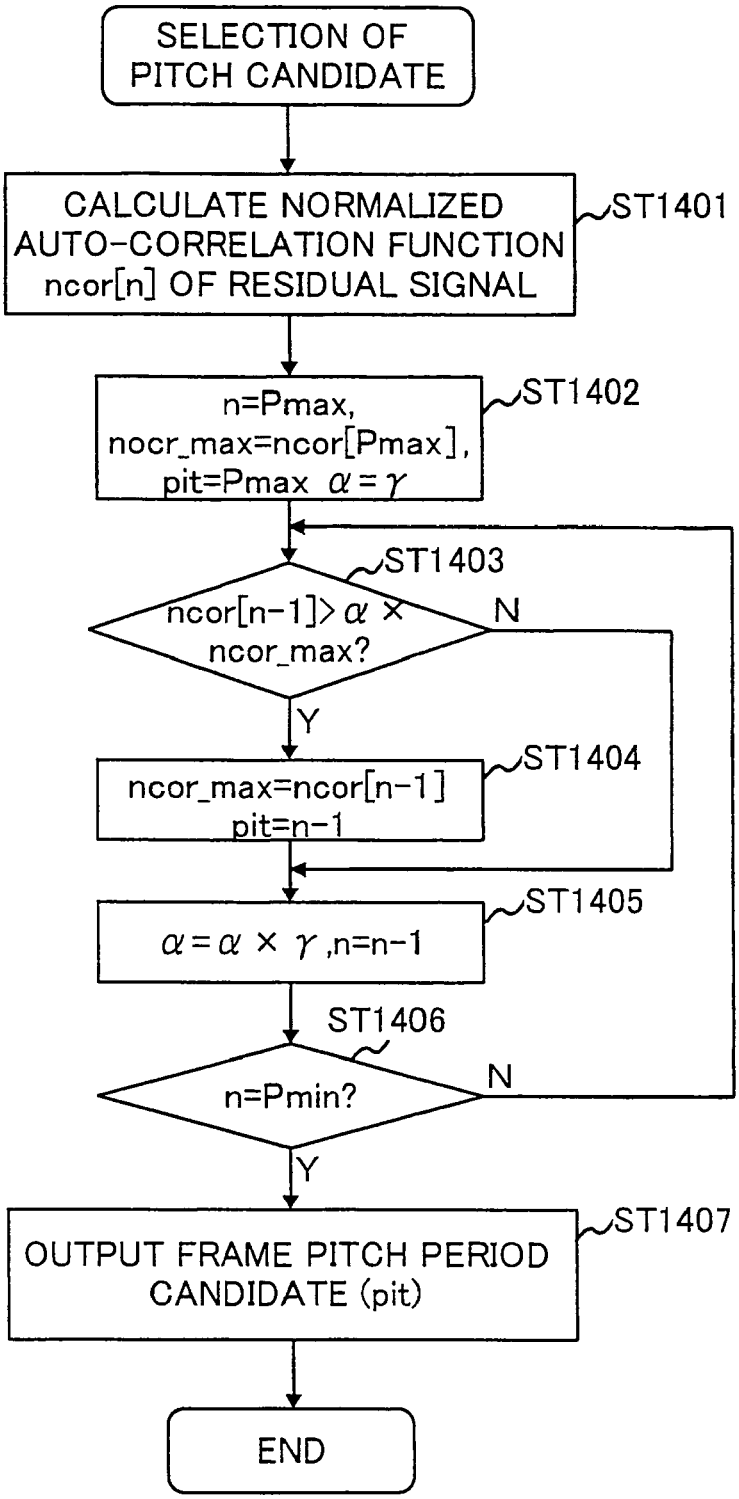
FIG. 14 is a flowchart for pitch period candidate selection with the weighting processing performed in the above embodiment.

FIG. 14 is a flow diagram when the weighting processing is performed according to the above-mentioned mode information. Auto-correlation function calculator 1301 calculates a normalized auto-correlation function of a residual signal (ST1401) (and outputs it accompanied with the corresponding pitch period). In other words, the calculator 1301 sets a sample time point from which the comparison is started (n=Pmax), and obtains a result of auto-correlation function at this time point (ST1402). The sample time point from which the comparison is started exists at a point timewise back the farthest.

Next, the comparison is performed between a weighted result of the auto-correlation function at the sample time point (ncor_max×α) and a result of the auto-correlation function at another sample time point closer to the current sub-frame than the sample time point (ncor[n−1]) (ST1403). In this case, the weighting is set so that the result on the closer sample time point is larger (α<1).

Then, when (ncor[n−1]) is larger than (ncor_max×α), a maximum value (ncor_max) at this time point is set to (ncor[n−1]), and a pitch is set to n−1 (ST1401). The weighting value α is multiplied by a coefficient γ (for example, 0.994 in this example), a value of n is set to the next sample time point (n−1) (ST1405), and it is judged whether n is a maximum value (Pmin) (ST1406). Meanwhile, when (ncor[n−1]) is not larger than (ncor_max×α), the weighting value α is multiplied by a coefficient γ (0<γ≦1.0, for example, 0.994 in this example), a value of n is set to the next sample time point (n−1) (ST1405), and it is judged whether n is a maximum value (Pmin) (ST1406). The judgement is performed in optimum pitch selector 1303.

When n is Pmin, the comparison is finished and a frame pitch period candidate (pit) is output. When p is not Pmin, the processing returns to ST1403 and the series of processing is repeated.

By performing such weighting, in other words, by decreasing a weighting coefficient (α) as the sample time point shifts toward the present sub-frame, a threshold for the auto-correlation function at a closer (closer to the current sub-frame) sample point is decreased, whereby a short period tends to be selected, thereby avoiding the multiplied pitch period error.

Figure 15:
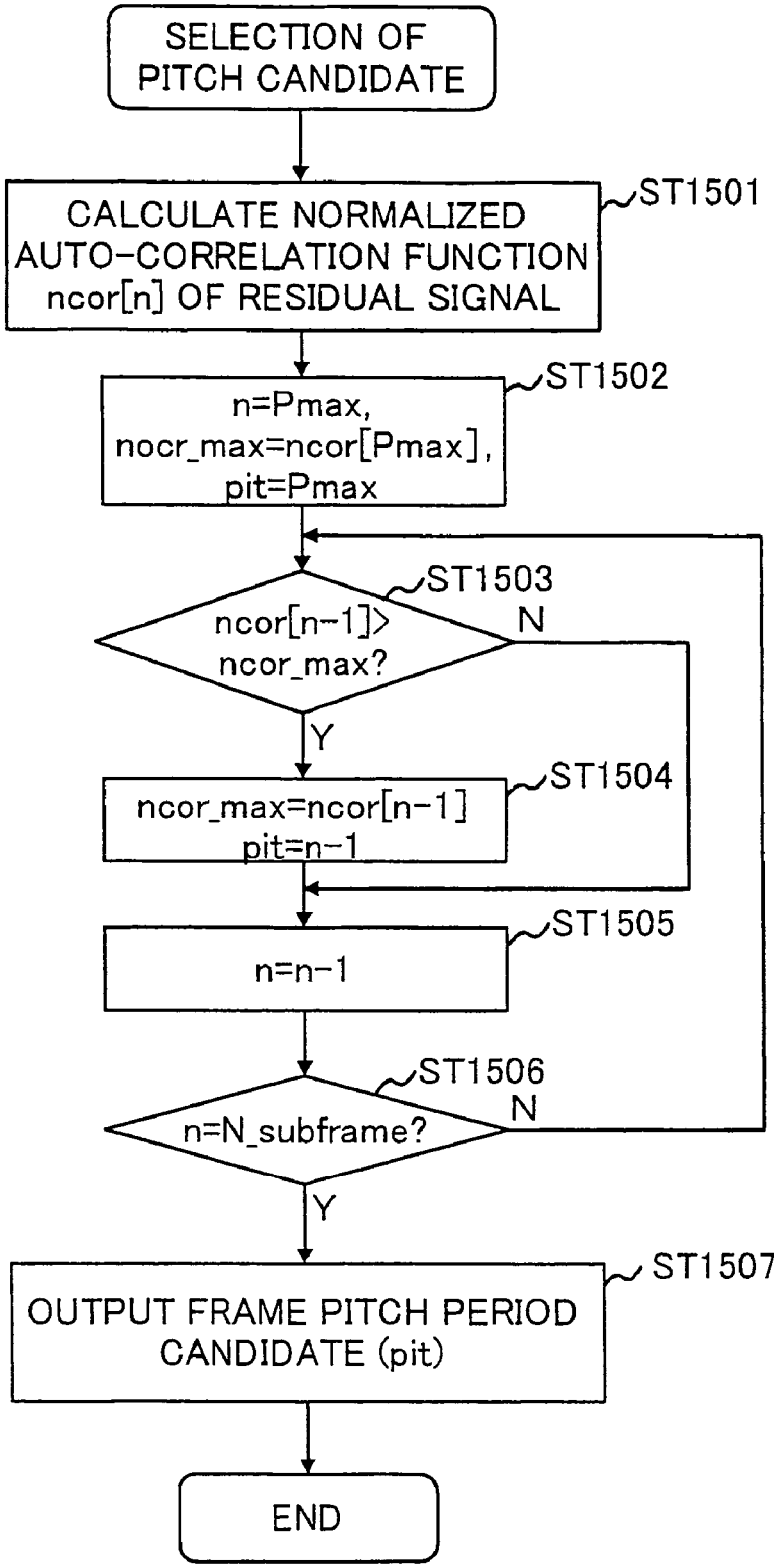
FIG. 15 is a flowchart for pitch period candidate selection with no weighting processing performed in the above embodiment.

FIG. 15 is a flow diagram when a pitch candidate is selected without performing weighting processing. Auto-correlation function calculator 1301 calculates a normalized auto-correlation function of a residual signal (ST1501) (and outputs it accompanied with the corresponding pitch period). In other words, the calculator 1301 sets a sample time point from which the comparison is started (n=Pmax), and obtains a result of auto-correlation function at this time point (ST1502). The sample time point from which the comparison is started exists at a point timewise back the farthest.

Next, the comparison is performed between a result of the auto-correlation function at the sample time point (ncor_max) and a result of the auto-correlation function at another sample time point closer to the current sub-frame than the sample time point (ncor[n−1]) (ST1503).

Then, when (ncor[n−1]) is larger than (ncor_max), a maximum value (ncor_max) at this time point is set to (ncor[n−1]), and a pitch is set to n−1 (ST1504). A value of n is set to the next sample time point (n−1) (ST1505), and it is judged whether n is a subframe (N_subframe) (ST1506). Meanwhile, (ncor[n−1]) is not larger than (ncor_max), a value of n is set to the next sample time point (n−1) (ST1505), and it is judged whether n is a subframe (N_subframe) (ST1506). The judgement is performed in optimum pitch selector 1303.

When n is the subframe length (N_subframe), the comparison is finished, and a frame pitch period candidate (pit) is output. When n is not the subframe length (N_subframe), the sample point shifts to the next point, the processing flow returns to ST1503, and the series of processing is repeated.

Thus, the pitch search is performed in a range such that the pitch periodicity does not occur in a subframe and a shorter pitch is not given a priority, whereby it is possible to suppress subjective quality deterioration in a stationary noise mode. In the selection of pitch period candidate, the comparison is performed on all the sample time points to select a maximum value. However, it may be possible in the present invention to divide a sample time point into at least two ranges, obtains a maximum value in each range, and compare the maximum values. Further, the pitch search may be performed in ascending order of pitch period.

Seventh Embodiment

In this embodiment is described a case that whether to use an adaptive codebook is switched according to the mode information selected in the above-mentioned embodiment. In other words, the adaptive codebook is not used when the mode information is indicative of a stationary noise mode (or stationary noise mode and unvoiced mode).

Figure 16:
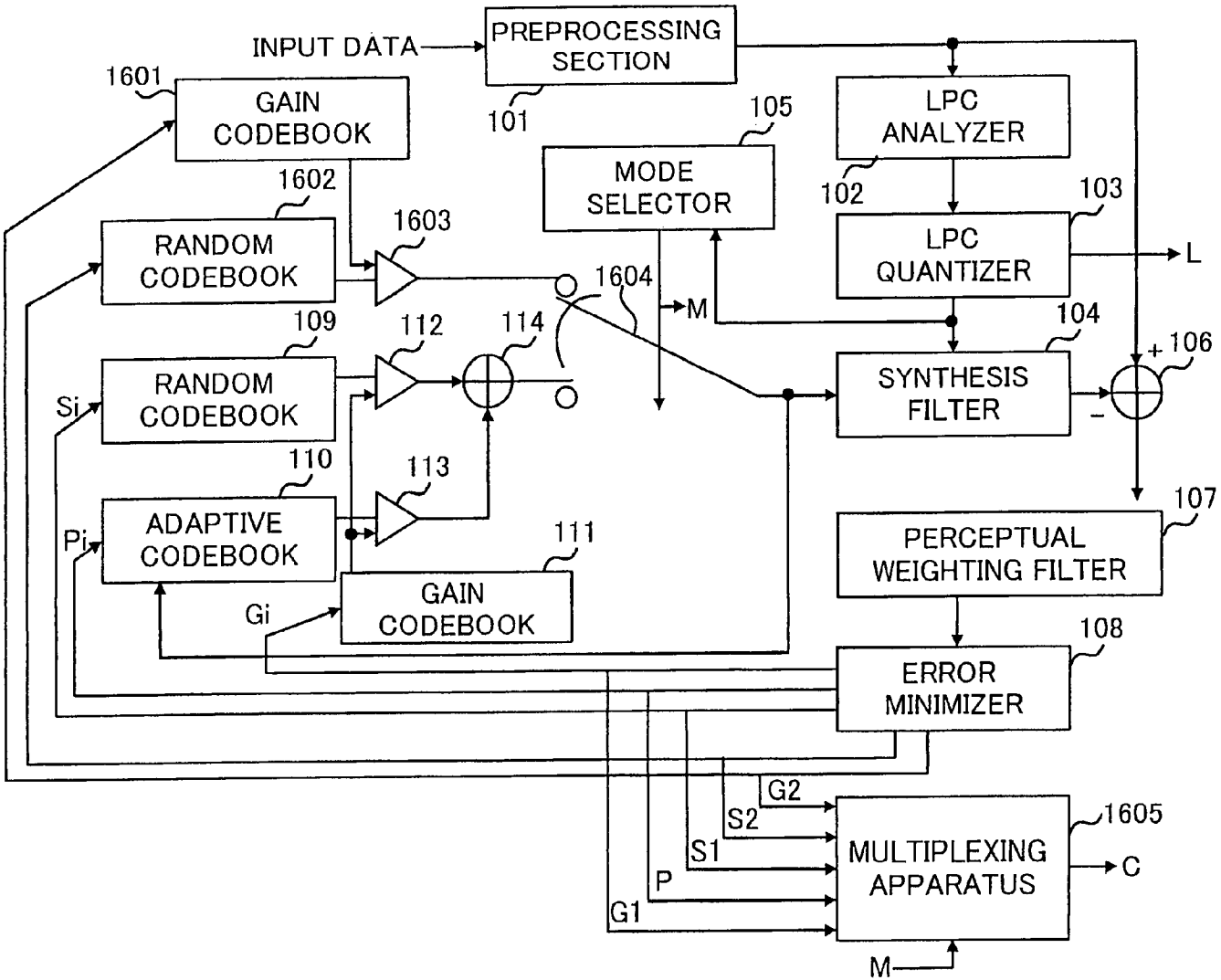
FIG. 16 is a block diagram illustrating a configuration of a speech coding apparatus in a seventh embodiment of the present invention.

FIG. 16 is a block diagram illustrating a configuration of a speech coding apparatus according to this embodiment. In FIG. 16, the same sections as those illustrated in FIG. 1 are assigned the same reference numerals to omit specific explanation thereof.

The speech coding apparatus illustrated in FIG. 16 has random codebook 1602 for use in a stationary noise mode, gain codebook 1601 for random codebook 1602, multiplier 1603 that multiplies a random code vector from random codebook 1602 by a gain, switch 1604 that switches codebooks according to the mode information from mode selector 105, and multiplexing apparatus 1605 that multiplexes codes to output a multiplexed code.

In the speech decoding apparatus with the above configuration, according to the mode information from mode selector 105, switch 1604 switches between a combination of adaptive codebook 110 and random codebook 109, and random codebook 1602. That is, switch 1604 switches between a combination of code S1 for random codebook 109, code P for adaptive codebook 110 and code G1 for gain codebook 111, and another combination of code S2 for random codebook 1602 and code G2 for gain codebook 1601 according to mode information M output from mode selector 105.

When mode selector 105 outputs the information indicative of a stationary noise mode (stationary noise mode and unvoiced mode), switch 1604 switches to random codebook 1602 not to use the adaptive codebook. Meanwhile, when mode selector 105 outputs another information other than the information indicative of a stationary noise mode (or stationary noise mode and unvoiced mode), switch 1604 switches to random codebook 109 and adaptive codebook 119.

Code S1 for random codebook 109, code P for adaptive codebook 110, code G1 for gain codebook 111, code S2 for random codebook 1602 and code G2 for gain codebook 1601 are once input to multiplexing apparatus 1605. Multiplexing apparatus 105 selects either combination described above according to mode information M, and outputs multiplexed code G on which codes of the selected combination are multiplexed.

Figure 17:
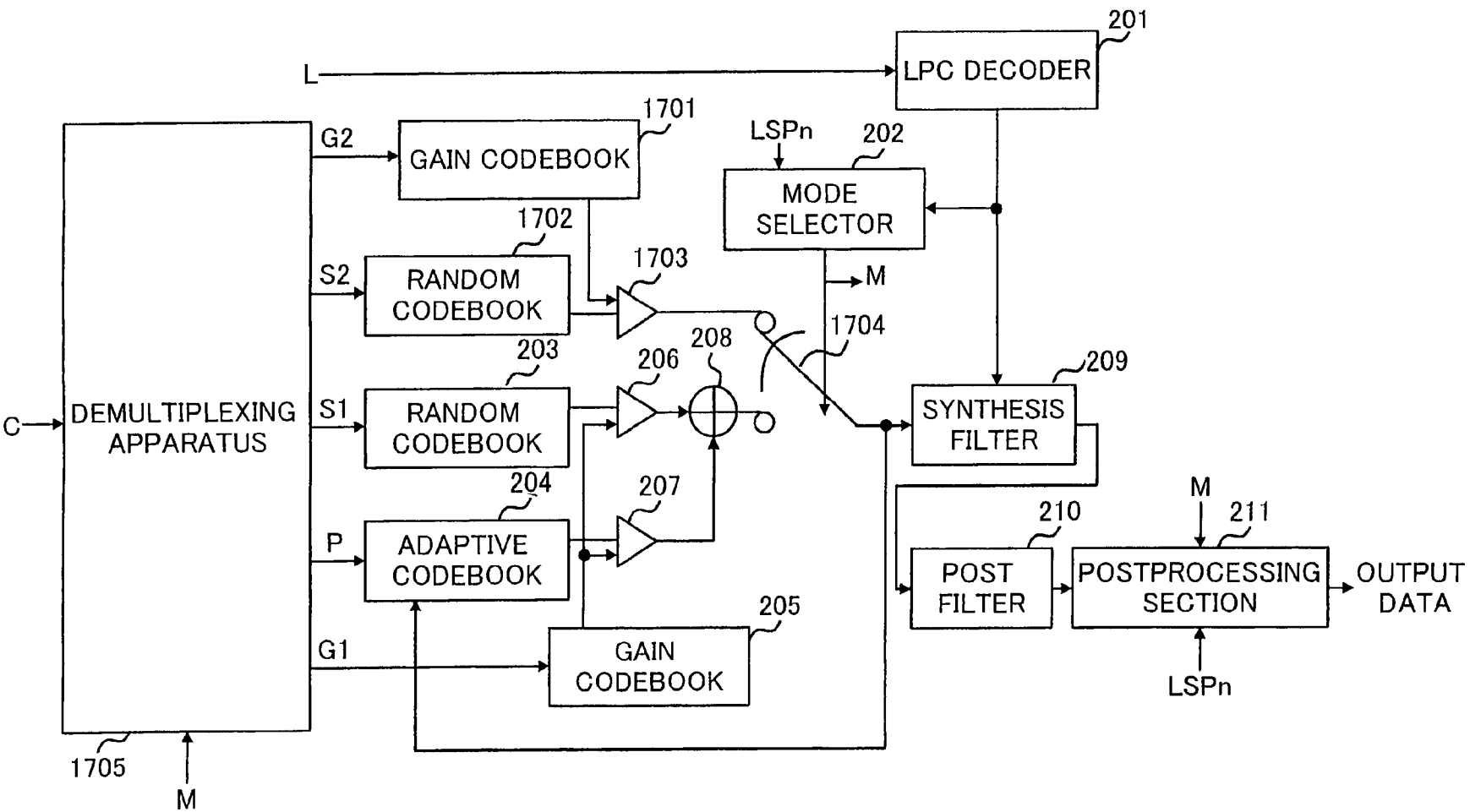
FIG. 17 is a block diagram illustrating a configuration of a speech decoding apparatus in the seventh embodiment of the present invention.

FIG. 17 is a block diagram illustrating a configuration of a speech decoding apparatus according to this embodiment. In FIG. 17, the same sections as those illustrated in FIG. 2 are assigned the same reference numerals to omit specific explanation thereof.

The speech decoding apparatus illustrated in FIG. 17 has random codebook 1702 for use in a stationary noise mode, gain codebook 1701 for random codebook 1702, multiplier 1703 that multiplies a random code vector from random codebook 1702 by a gain, switch 1704 that switches codebooks according to the mode information from mode selector 202, and demultiplexing apparatus 1705 that demultiplexes a multiplexed code.

In the speech decoding apparatus with the above configuration, according to the mode information from mode selector 202, switch 1704 switches between a combination of adaptive codebook 204 and random codebook 203, and random codebook 1702. That is, multiplexed code C is input to demultiplexing apparatus 1705, the mode information is first demultiplexed and decoded, and according to the decoded mode information, either a code set of G1, P and S1 or a code set of G2 and S2 is demultiplexed and decoded. Code G1 is output to gain codebook 205, code P is output to adaptive codebook 204, and code S1 is output to random codebook 203. Code S2 is output to random codebook 1702, and code G2 is output to gain codebook 1701.

When mode selector 202 outputs the information indicative of a stationary noise mode (stationary noise mode and unvoiced mode), switch 1704 switches to random codebook 1702 not to use the adaptive codebook. Meanwhile, when mode selector 202 outputs another information other than the information indicative of a stationary noise mode (or stationary noise mode and unvoiced mode), switch 1704 switches to random codebook 203 and adaptive codebook 204.

Whether to use the adaptive code is thus switched according to the mode information, whereby an appropriate excitation mode is selected corresponding to a state of an input (speech) signal, and it is thereby possible to improve the quality of a decoded signal.

Eighth Embodiment

In this embodiment is described a case that a pseudo stationary noise generator is used according to the mode information.

As an excitation of a stationary noise, it is preferable to use an excitation such as a white Gaussian noise as possible. However, in the case where a pulse excitation is used as an excitation, it is not possible to generate a desired stationary noise when a corresponding signal is passed through the synthesis filter. Hence, this embodiment provides a stationary noise generator composed of an excitation generating section that generates an excitation such as a white Gaussian noise, and an LSP synthesis filter representative of a spectral envelope of a stationary noise. The stationary noise generated in this stationary noise generator is not represented by a configuration of CELP, and therefore the stationary noise generator with the above configuration is modeled to be provided in a speech decoding apparatus. Then, the stationary noise signal generated in the stationary noise generator is added to decoded signal regardless of the speech region or non-speech region.

In addition, in the case where the stationary noise signal is added to decoded signal, a noise level tends to be small at a noise region when a fixed perceptual weighting is always performed. Therefore, it is possible to adjust the noise level not to be excessively large even if the stationary noise signal is added to decoded signal.

Further, in this embodiment, a noise excitation vector is generated by selecting a vector randomly from the random codebook that is a structural element of a CELP type decoding apparatus, and with the generated noise excitation vector as an excitation signal, a stationary noise signal is generated with the LPC synthesis filter specified by the average LSP of a stationary noise region. The generated stationary noise signal is scaled to have the same power as the average power of the stationary noise region and further multiplied by a constant scaling number (about 0.5), and added to a decoded signal (post filter output signal). It may be also possible to perform scaling processing on an added signal to adapt the signal power with the stationary noise added thereto to the signal power with no stationary noise added.

Figure 18:
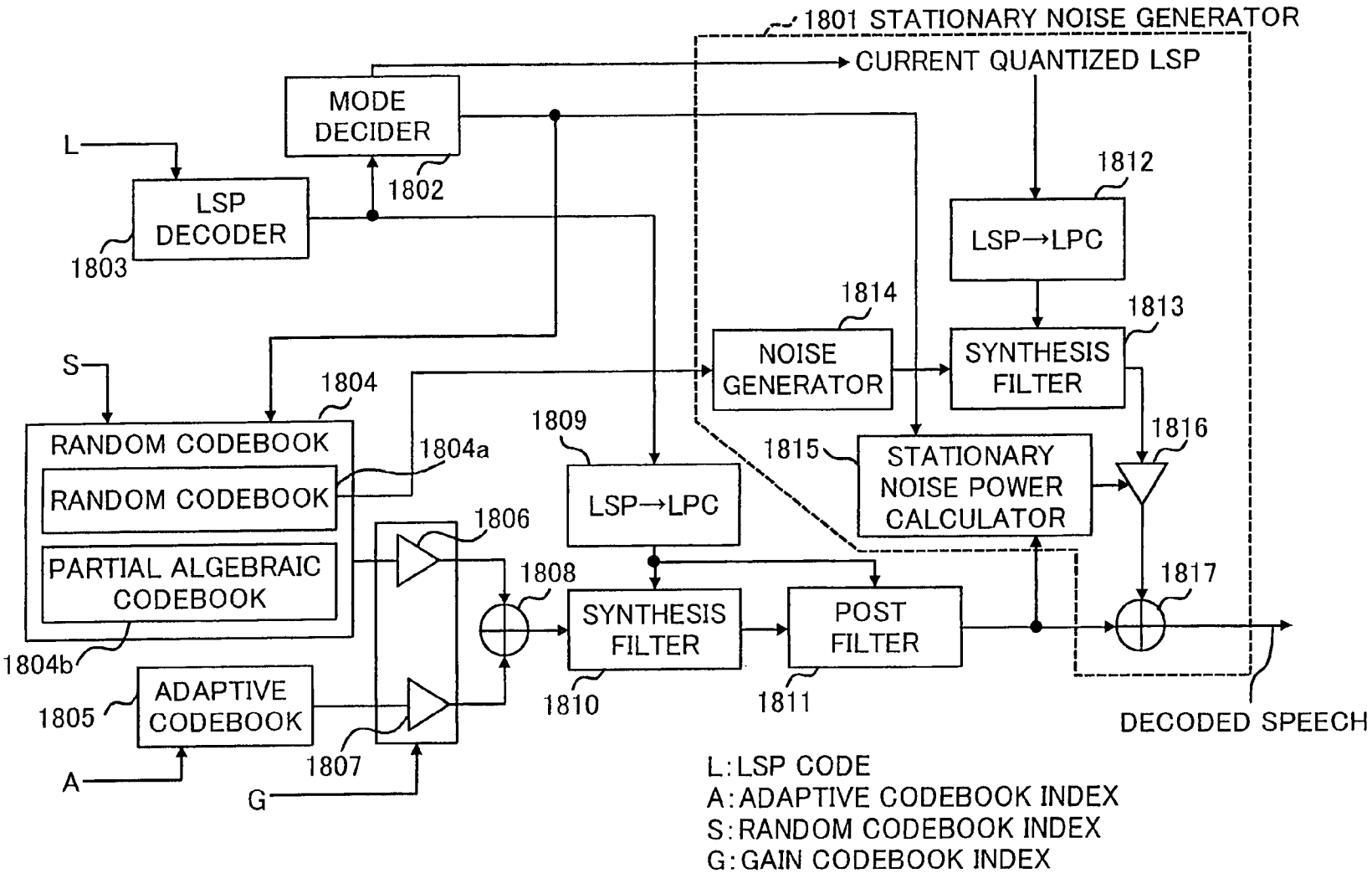
FIG. 18 is a block diagram illustrating a configuration of a speech decoding apparatus in an eighth embodiment of the present invention.

FIG. 18 is a block diagram illustrating a configuration of a speech decoding apparatus according to this embodiment. Stationary noise generator 1801 has LPC converter 1812 that converts the average LSP of a noise region into LPC, noise generator 1814 that receives as its input a random signal from random codebook 1804*a* in random codebook 1804 to generate a noise, synthesis filter 1813 driven by the generated noise signal, stationary noise power calculator 1815 that calculates power of a stationary noise based on a mode determined in mode decider 1802, and multiplier 1816 that multiplies the noise signal synthesized in synthesis filter 1813 by the power of the stationary noise to perform the scaling.

In the speech decoding apparatus provided with such a pseudo stationary noise generator, LSP code L, codebook index S representative of a random code vector, codebook index A representative of an adaptive code vector, codebook index G representative of gain information each transmitted from a coder are respectively input to LPC decoder 1803, random codebook 1804, adaptive codebook 1805, and gain codebook.

LSP decoder 1803 decodes quantized LSP from LSP code L to output to mode decider 1802 and LPC converter 1809.

Figure 19:
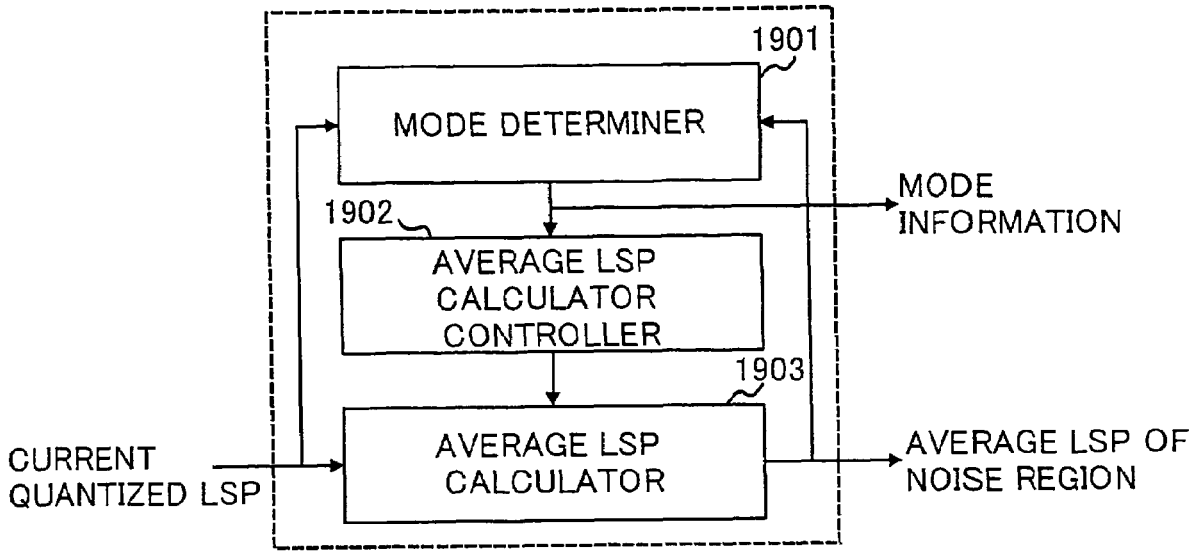
FIG. 19 is a block diagram illustrating a configuration of a mode determiner in the speech decoding apparatus in the above embodiment.

Mode decider 1802 has a configuration as illustrated in FIG. 19. Mode determiner 1901 determines a mode using the quantized LSP input from LSP decoder 1803, and provides the mode information to random codebook 1804 and LPC converter 1809. Further, average LSP calculator controller 1902 controls average LSP calculator 1903 based on the mode information determined in mode determiner 1901. That is, average LSP calculator controller 1902 controls average LSP calculator 1902 in a stationary noise mode so that the calculator 1902 calculates average LSP of a noise region from current quantized LSP and previous quantized LSP. The average LSP of a noise region is output to LPC converter 1812, while being output to mode determiner 1901.

Random codebook 1804 stores a predetermined number of random code vectors with different shapes, and outputs a random code vector designated by a random codebook index obtained by decoding the input code S. Further, random codebook 1804 has random codebook 1804*a* and partial algebraic codebook 1804*b* that is an algebraic codebook, and for example, generates a pulse-like random code vector from partial algebraic codebook 1804*b* in a mode corresponding to a voiced speech region, while generating a noise-like random code vector from random codebook 1804*a* in modes corresponding to an unvoiced speech region and stationary noise region.

According to a result decided in mode decider 1802, a ratio is switched of the number of entries of random codebook 1804*a* and the number of entries of partial algebraic codebook 1804*b*. As a random code vector output from random codebook 1804, an optimal vector is selected from the entries of at least two types of modes described above. Multiplier 1806 multiplies the selected vector by the random codebook gain G to output to adder 1808.

Adaptive codebook 1805 performs buffering while updating the previously generated excitation vector signal sequentially, and generates an adaptive code vector using the adaptive codebook index (pitch period (pitch lag)) obtained by decoding the input code P. The adaptive code vector generated in adaptive codebook 1805 is multiplied by the adaptive codebook gain G in multiplier 1807, and then output to adder 1808.

Adder 1808 adds the random code vector and the adaptive code vector respectively input from multipliers 1806 and 1807 to generate the excitation vector signal, and outputs the generated excitation vector signal to synthesis filter 1810.

As synthesis filter 1810, an LPC synthesis filter is constructed using the input quantized LPC. With the constructed synthesis filter, the filtering processing is performed on the excitation vector signal input from adder 1808, and the resultant signal is output to post filter 1811.

Post filter 1811 performs the processing to improve subjective qualities of speech signals such as pitch emphasis, formant emphasis, spectral tilt compensation and gain adjustment on the synthesized signal input from synthesis filter 1810.

Meanwhile, the average LSP of a noise region output from mode determiner 1802 is input to LPC converter 1812 of stationary noise generator 1801 to be converted into LPC. This LPC is input to synthesis filter 1813.

Noise generator 1814 selects a random vector randomly from random codebook 1804*a*, and generates a random signal using the selected vector. Synthesis filter 1813 is driven by the noise signal generated in noise generator 1814. The synthesized noise signal is output to multiplier 1816.

Stationary noise power calculator 1815 judges a reliable stationary noise region using the mode information output from mode decider 1802 and information on signal power change output from post filter 1811. The reliable stationary noise region is a region such that the mode information is indicative of a non-speech region (stationary noise region), and that the power change is small. When the mode information is indicative of a stationary noise region with the power changing to increase greatly, the region has a possibility of being a region where a speech onset, and therefore is treated as a speech region. Then, the calculator 1815 calculates average power of the region judged to be a stationary noise region. Further, the calculator 1815 obtains a scaling coefficient to be multiplied in multiplier 1816 by an output signal of synthesis filter 1813 so that the power of the stationary noise signal to be multiplexed on a decoded speech signal is not excessively large, and that the power resulting from multiplying the average power by a constant coefficient is obtained. Multiplier 1816 performs the scaling on the noise signal output from synthesis filter 1813, using the scaling coefficient output from stationary noise power calculator 1815. The noise signal subjected to the scaling is output to adder 1817. Adder 1817 adds the noise signal subjected to the scaling to an output from post filter 1811, and thereby the decoded speech is obtained.

In the speech decoding apparatus with the above configuration, since pseudo stationary noise generator 1801 is used that is of filter drive type which generates an excitation randomly, using the same synthesis filter and the same power information repeatedly does not cause a buzzer-like noise arising due to discontinuity between segments, and thereby it is possible to generate natural noises.

The present invention is not limited to the above-mentioned first to eighth embodiments, and is capable of being carried into practice with various modifications thereof. For example, the above-mentioned first to eighth embodiments are capable of being carried into practice in a combination thereof as appropriate. A stationary noise generator of the present invention is capable of being applied to any type of a decoder, which may be provided with means for supplying the average LSP of a noise region, means for judging a noise region (mode information), a proper noise generator (or proper random codebook), and means for supplying (calculating) average power (average energy) of a noise region, as appropriate.

A multimode speech coding apparatus of the present invention has a configuration including a first coding section that encodes at least one type of parameter indicative of vocal tract information contained in a speech signal, a second coding section capable of coding at least one type of parameter indicative of vocal tract information contained in the speech signal with a plurality of modes, a mode determining section that determines a mode of the second coding section based on a dynamic characteristic of a specific parameter coded in the first coding section, and a synthesis section that synthesizes an input speech signal using a plurality of types of parameter information coded in the first coding section and the second coding section, where the mode determining section has a calculating section that calculates an evolution of a quantized LSP parameter between frames, a calculating section that calculates an average quantized LSP parameter on a frame where the quantized LSP parameter is stationary, and a detecting section that calculates a distance between the average quantized LSP parameter and a current quantized LSP parameter, and detects a predetermined amount of a difference in a particular order between the quantized LSP parameter and the average quantized LSP parameter.

According to this configuration, since a predetermined amount of a difference in a particular order between a quantized LSP parameter and an average quantized LSP parameter is detected, even when a region is not judged to be a speech region in performing the judgment on the average result, the region can be judged to be a speech region with accuracy. It is thereby possible to determine a mode accurately even when a value of the average quantized LSP of a noise region is highly similar to that of the quantized LSP of the region, and an evolution in the quantized LSP in the region is very small.

A multimode speech coding apparatus of the present invention further has, in the above configuration, a search range determining section that limits a pitch period search range to a range that does not include a last subframe when a mode is a stationary noise mode.

According to this configuration, a search range is limited to a region that does not include a last frame in a stationary noise mode (or stationary noise mode and unvoiced mode), whereby it is possible to suppress the pitch periodicity on a random code vector and to prevent a coding distortion caused by a pitch synchronization model from occurring in a decoded speech signal.

A multimode speech coding apparatus further has, in the above configuration, a pitch synchronization gain control section that controls a pitch synchronization gain corresponding to a mode in determining a pitch period using a codebook.

According to this configuration, it is possible to avoid periodical emphasis in a subframe, whereby it is possible to prevent a coding distortion caused by a pitch synchronization model from occurring in generating an adaptive code vector.

In a multimode speech coding apparatus of the present invention with the above configuration, the pitch synchronization gain control section controls the gain for each random codebook.

According to this configuration, a gain is changed for each random codebook in a stationary noise mode (or stationary noise mode and unvoiced mode), whereby it is possible to suppress the pitch periodicity on a random code vector and to prevent a coding distortion caused by a pitch synchronization model from occurring in generating a random code vector.

In a multimode speech coding apparatus of the present invention with the above configuration, when a mode is a stationary noise mode, the pitch synchronization gain control section decreases the pitch synchronization gain.

A multimode speech coding apparatus of the present invention further has, in the above configuration, an auto-correlation function calculating section that calculates an auto-correlation function of a residual signal of an input speech, a weighting processing section that performs weighting on a result of the auto-correlation function corresponding to a mode, and a selecting section that selects a pitch candidate using a result of the weighted auto-correlation function.

According to the configuration, it is possible to avoid quality deterioration on a decoded speech signal that does not have a pitch structure.

A multimode speech decoding apparatus of the present invention has a first decoding section that decodes at least one type of parameter indicative of vocal tract information contained in a speech signal, a second decoding section capable of decoding at least one type of parameter indicative of vocal tract information contained in the speech signal with a plurality of decoding modes, a mode determining section that determines a mode of the second decoding section based on a dynamic characteristic of a specific parameter decoded in the first decoding section, and a synthesis section that decodes the speech signal using a plurality of types of parameter information decoded in the first decoding section and the second decoding section, where the mode determining section has a calculating section that calculates an evolution of a quantized LSP parameter between frames, a calculating section that calculates an average quantized LSP parameter on a frame where the quantized LSP parameter is stationary, and a detecting section that calculates a distance between the average quantized LSP parameter and a current quantized LSP parameter, and detects a predetermined amount of difference in a particular order between the quantized LSP parameter and the average quantized LSP parameter.

According to this configuration, since a predetermined amount of a difference in a particular order between a quantized LSP parameter and an average quantized LSP parameter is detected, even when a region is not judged to be a speech region in performing the judgment on the average result, the region can be judged to be a speech region with accuracy. It is thereby possible to determine a mode accurately even when a value of the average quantized LSP of a noise region is highly similar to that of the quantized LSP of the region, and an evolution in the quantized LSP in the region is very small.

A multimode speech decoding apparatus of the present invention further has, in the above configuration, a stationary noise generating section that outputs an average LSP parameter of a noise region, while generating a stationary noise by driving, using a random signal acquired from a random codebook, a synthesis filter constructed with an LPC parameter obtained from the average LSP parameter, when the mode determined in the mode determining section is a stationary noise mode.

According to this configuration, since pseudo stationary noise generator 1801 is used that is of filter drive type which generates an excitation randomly, using the same synthesis filter and the same power information repeatedly does not cause a buzzer-like noise arising due to discontinuity between segments, and thereby it is possible to generate natural noises.

As described above, according to the present invention, a maximum value is judged with a threshold by using the third dynamic parameter in determining a mode, whereby even when most of the results does not exceed the threshold with one or two results exceeding the threshold, it is possible to judge a speech region with accuracy.

This application is based on the Japanese Patent Applications No. 2000-002874 filed on Jan. 11, 2000, an entire content of which is expressly incorporated by reference herein. Further the present invention is basically associated with a mode determiner that determines a stationary noise region using an evolution of LSP between frames and a distance between obtained LSP and average LSP of a previous noise region (stationary region). The content is based on the Japanese Patent Applications No. HEI10-236147 filed on Aug. 21, 1998, and No. HEI10-266883 filed on Sep. 21, 1998, entire contents of which are expressly incorporated by reference herein.

INDUSTRIAL APPLICABILITY

The present invention is applicable to a low-bit-rate speech coding apparatus, for example, in a digital mobile communication system, and more particularly to a CELP type speech coding apparatus that separates the speech signal to vocal tract information and excitation information to represent.

The invention claimed is:

1. A speech decoding apparatus comprising:

a decoder that decodes a code representing a quantized LPC and generates a decoded LSP parameter for a current frame;

a mode determining apparatus that calculates an average decoded LSP parameter in a period in which a decoded LSP parameter is stationary and determines whether the current frame indicates a speech mode or non-speech mode utilizing the average decoded LSP parameter; and a stationary noise generator that drives a synthesis filter with a random signal obtained from a random codebook, the synthesis filter comprising an LPC parameter obtained from the average decoded LSP parameter calculated in a period other than a period in which the mode determining apparatus determined to indicate the speech mode, and generates a stationary noise signal and superimposes the stationary noise signal over a decoded speech signal.

2. A speech decoding apparatus according to claim 1, wherein the mode determining apparatus comprises:

an average LSP calculator that calculates the average decoded LSP parameter;

a difference calculator that calculates differences between order components of the average decoded LSP parameter and corresponding order components of the decoded LSP parameter in the current frame, respectively; and a first mode determiner that determines that the current frame indicates the speech mode when a difference greater than a predetermined level is calculated between at least one pair of order components.

3. A speech decoding apparatus according to claim 2, wherein the mode determining apparatus further comprises:

an inter-frame change calculator that calculates inter-frame changes in the decoded LSP parameter; and a second mode determiner that determines that a period indicates the speech mode when the period shows an inter-frame change greater than a predetermined level, wherein:

the average LSP calculator deals with a period which is not the period determined by the second mode determiner to indicate the speech mode as the period in which the decoded LSP parameter is stationery;

the first mode determiner determines whether the period is not the period determined by the second mode determiner to indicate the speech mode; and two step mode determination is performed by using the first mode determiner and the second mode determiner.

4. A speech decoding method comprising:

a decoding step of decoding a code representing a quantized LPC and generating a decoded LSP parameter for a current frame;

a mode determining step of calculating an average decoded LSP parameter in a period in which a decoded LSP parameter is stationary and determining whether the current frame indicates a speech mode or non-speech mode utilizing the average decoded LSP parameter; and a stationary noise generating step of driving a synthesis filter with a random signal obtained from a random codebook, the synthesis filter comprising an LPC parameter obtained from the average decoded LSP parameter calculated in a period other than a period in which the mode determining step determined to indicate the speech mode, and generating a stationary noise signal and superimposing the stationary noise signal over a decoded speech signal.

5. A speech decoding method according to claim 4, wherein the mode determining step comprises:

an average LSP calculating step of calculating the average decoded LSP parameter;

a difference calculating step of calculating differences between order components of the average decoded LSP parameter and corresponding order components of the decoded LSP parameter in the current frame, respectively; and a first mode determining step determining that the current frame indicates the speech mode when a difference greater than a predetermined level is calculated between at least one pair of order components.

6. A speech decoding method according to claim 5, wherein the mode determining step further comprises:

an inter-frame change calculating step of calculating inter-frame changes in the decoded LSP parameter; and a second mode determining step of determining that a period indicates the speech mode when the period shows an inter-frame change greater than a predetermined level, wherein:

the average LSP calculating step of dealing with a period which is not the period determined by the second mode determiner to indicate the speech mode as a period in which the decoded LSP parameter is stationery;

the first mode determining step of determining whether the period is not the period determined by the second mode determining step to indicate the speech mode; and two step mode determination is performed by using the first mode determining step and the second mode determining step.

* * * * *

UNITED STATES PATENT AND TRADEMARK OFFICE

CERTIFICATE OF CORRECTION

PATENT NO. : 7,577,567 B2
APPLICATION NO. : 11/637128
DATED : August 18, 2009
INVENTOR(S) : Hiroyuki Ehara It is certified that error appears in the above-identified patent and that said Letters Patent is hereby corrected as shown below:

On the title page, Item (30): Foreign Application Priority Data, is omitted in the Letters Patent, and should read:

"January 11, 2000 (JP)..... 2000-002874"

On the title page, Item (63): Related U.S. Application Data, currently reads:

"Continuation of application No. 09/914,916, filed on September 6, 2001, now Pat No. 7,167,828"

and should read:

"Continuation of application No. 09/914,916, filed as PCT/JP01/00062 on January 10, 2001, now Pat. No. 7,167,828"

Signed and Sealed this

Sixth Day of April, 2010

David J. Kappos

David J. Kappos
*Director of the United States Patent and Trademark Office*